US008967255B2

(12) United States Patent
Szarka et al.

(10) Patent No.: US 8,967,255 B2
(45) Date of Patent: Mar. 3, 2015

(54) SUBSURFACE RELEASE CEMENTING PLUG

(75) Inventors: David D. Szarka, Duncan, OK (US); David E. Y. Levie, Kastanienbaum (CH)

(73) Assignee: Halliburton Energy Services, Inc., Houston, TX (US)

( * ) Notice: Subject to any disclaimer, the term of this patent is extended or adjusted under 35 U.S.C. 154(b) by 488 days.

(21) Appl. No.: 13/289,642

(22) Filed: Nov. 4, 2011

(65) Prior Publication Data

US 2013/0112410 A1 May 9, 2013

(51) Int. Cl.
*E21B 33/14* (2006.01)
*E21B 33/16* (2006.01)

(52) U.S. Cl.
CPC ..... *E21B 33/16* (2013.01)
USPC ..... 166/291; 166/177.5

(58) Field of Classification Search
CPC ..... E21B 33/14; E21B 33/16
USPC ..... 166/285, 291, 177.4
See application file for complete search history.

(56) References Cited

U.S. PATENT DOCUMENTS

| | | | |
|---|---|---|---|
| 2,925,865 | A | 2/1960 | Oliver |
| 3,211,232 | A | 10/1965 | Grimmer |
| 3,768,556 | A | 10/1973 | Baker |
| 4,364,430 | A | 12/1982 | Szarka |
| 4,369,840 | A | 1/1983 | Szarka et al. |
| 4,421,165 | A | 12/1983 | Szarka |
| 4,441,721 | A | 4/1984 | Harris et al. |
| 4,479,545 | A | 10/1984 | Eley |
| 4,482,069 | A | 11/1984 | Stadler |
| 4,574,882 | A | 3/1986 | Szarka |
| 4,606,408 | A | 8/1986 | Zunkel et al. |
| 4,613,159 | A | 9/1986 | Harris et al. |
| 4,627,488 | A | 12/1986 | Szarka |
| 4,669,538 | A | 6/1987 | Szarka |
| 4,669,541 | A | 6/1987 | Bissonnette |
| 4,697,640 | A | 10/1987 | Szarka |
| 4,718,495 | A | 1/1988 | Lubitz et al. |
| 4,880,058 | A | 11/1989 | Lindsey et al. |

(Continued)

FOREIGN PATENT DOCUMENTS

EP 0697496 A2 2/1996

OTHER PUBLICATIONS

Weatherford product brochure entitled, "POST™ Pack-Off Stage Tool: Model 781," 2008, Houston, TX, 1 page, Weatherford International Ltd.

(Continued)

*Primary Examiner* — William P Neuder
(74) *Attorney, Agent, or Firm* — John W. Wustenberg; Baker Botts L.L.P.

(57) ABSTRACT

A subsurface release plug release apparatus comprising a mandrel comprising a bottom plug portion, a top plug portion, a work string attachment portion, a first release portion between the bottom plug portion and the top plug portion, wherein the first release portion comprises a controlled strength segment configured to fail structurally and thereby release the bottom plug portion at a first fluid pressure, and a second release portion between the top plug portion and the work string attachment portion, wherein the second release portion is configured to release the bottom plug portion at a second fluid pressure, wherein the first fluid pressure is less than the second fluid pressure, a bottom plug body disposed about the bottom plug portion of the mandrel, and a top plug body disposed about the top plug portion of the mandrel.

30 Claims, 10 Drawing Sheets

(56) References Cited

U.S. PATENT DOCUMENTS

| | | | | |
|---|---|---|---|---|
| 4,917,184 | A | 4/1990 | Freeman et al. | |
| 4,949,788 | A | 8/1990 | Szarka et al. | |
| 4,979,561 | A | 12/1990 | Szarka | |
| 4,991,654 | A | 2/1991 | Brandell et al. | |
| 5,038,862 | A | 8/1991 | Giroux et al. | |
| 5,044,444 | A | 9/1991 | Coronado | |
| 5,109,925 | A | 5/1992 | Stepp et al. | |
| 5,137,087 | A | 8/1992 | Szarka et al. | |
| 5,178,216 | A | 1/1993 | Giroux et al. | |
| 5,277,253 | A | 1/1994 | Giroux et al. | |
| 5,279,370 | A | 1/1994 | Brandell et al. | |
| 5,314,015 | A | 5/1994 | Streich et al. | |
| 5,375,661 | A | 12/1994 | Daneshy et al. | |
| 5,381,862 | A | 1/1995 | Szarka et al. | |
| 5,394,941 | A | 3/1995 | Venditto et al. | |
| 5,413,172 | A * | 5/1995 | Laurel | 166/153 |
| 5,526,878 | A | 6/1996 | Duell et al. | |
| 5,641,021 | A | 6/1997 | Murray et al. | |
| 5,738,171 | A | 4/1998 | Szarka | |
| 5,762,139 | A * | 6/1998 | Sullaway et al. | 166/291 |
| 6,095,247 | A | 8/2000 | Streich et al. | |
| 6,244,342 | B1 | 6/2001 | Sullaway et al. | |
| 6,318,472 | B1 | 11/2001 | Rogers et al. | |
| 6,497,291 | B1 | 12/2002 | Szarka | |
| 6,547,007 | B2 | 4/2003 | Szarka et al. | |
| 6,571,876 | B2 | 6/2003 | Szarka | |
| 6,622,798 | B1 | 9/2003 | Rogers et al. | |
| 6,651,743 | B2 | 11/2003 | Szarka | |
| 6,725,935 | B2 | 4/2004 | Szarka et al. | |
| 6,772,835 | B2 | 8/2004 | Rogers et al. | |
| 6,810,958 | B2 | 11/2004 | Szarka et al. | |
| 6,880,636 | B2 | 4/2005 | Rogers et al. | |
| 6,923,255 | B2 | 8/2005 | Lee | |
| 6,973,966 | B2 | 12/2005 | Szarka | |
| 7,086,479 | B2 | 8/2006 | Schultz et al. | |
| 7,182,135 | B2 | 2/2007 | Szarka | |
| 7,255,162 | B2 | 8/2007 | Stevens et al. | |
| 7,322,413 | B2 | 1/2008 | Rogers et al. | |
| 7,350,578 | B2 | 4/2008 | Szarka et al. | |
| 7,506,686 | B2 | 3/2009 | Szarka | |
| 7,533,729 | B2 | 5/2009 | Rogers et al. | |
| 7,584,792 | B2 * | 9/2009 | Szarka | 166/291 |
| 7,665,520 | B2 | 2/2010 | Szarka et al. | |
| 7,673,688 | B1 | 3/2010 | Jones et al. | |
| 7,686,092 | B2 | 3/2010 | Szarka | |
| 8,132,619 | B2 * | 3/2012 | Smith et al. | 166/207 |
| 8,267,174 | B2 | 9/2012 | Rogers et al. | |
| 2010/0051276 | A1 | 3/2010 | Rogers et al. | |
| 2010/0206572 | A1 | 8/2010 | Makowiecki et al. | |

OTHER PUBLICATIONS

Halliburton Company Sales and Service Catalog, pp. 42-43 plus 1 cover page, 1964.

Foreign communication from a related counterpart application—International Search Report and Written Opinion, PCT/GB2010/000257, Aug. 20, 2010, 8 pages.

Foreign communication from a related counterpart application—International Search Report, PCT/GB2010/001570, Dec. 6, 2010, 4 pages.

Office Action dated Sep. 30, 2011 (21 pages), U.S. Appl. No. 12/544,554, filed Aug. 20, 2009.

Foreign communication from a related counterpart application—International Search Report and Written Opinion, PCT/US2012/062426, Feb. 14, 2014, 10 pages.

* cited by examiner

SUBSURFACE RELEASE CEMENTING PLUG

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

When wellbores are prepared for oil and gas production, it is common to cement a casing string within the wellbore. Often, it may be desirable to cement the casing within the wellbore in multiple, separate stages.

Conventionally, cementing a casing string within a wellbore is achieved by flowing cement to the bottom of the casing string and upward into the annular space between the casing string and the wellbore walls. In order to preserve the integrity of the cementitious slurry used to cement the casing within the wellbore, "cementing plugs" or "wiper plugs" are used to form a barrier between the cementitious slurry and other servicing fluids and reduce intermixing or intermingling between the cementitious slurry and any other fluid. It may be desirable to employ subsurface release cementing plugs, that is, cementing plugs that are released from a point within the wellbore below the Earth's surface, in a cementing operation. However, conventional subsurface release plugs are limited in application, for example, because of the relatively large diameter of conventional subsurface release cementing plug systems.

Therefore, there is a need for improved subsurface release plugs that may be employed in a wider range of applications.

SUMMARY OF THE INVENTION

Disclosed herein is a subsurface release plug release apparatus comprising a mandrel comprising a bottom plug portion, a top plug portion, a work string attachment portion, a first release portion between the bottom plug portion and the top plug portion, wherein the first release portion comprises a controlled strength segment configured to fail structurally and thereby release the bottom plug portion at a first fluid pressure, and a second release portion between the top plug portion and the work string attachment portion, wherein the second release portion is configured to release the bottom plug portion at a second fluid pressure, wherein the first fluid pressure is less than the second fluid pressure, a bottom plug body disposed about the bottom plug portion of the mandrel, and a top plug body disposed about the top plug portion of the mandrel.

Further disclosed herein is a wellbore servicing method comprising positioning a casing defining a flowbore within a wellbore with a subsurface release plug release apparatus disposed within a portion of the casing, the subsurface release plug release apparatus comprising a mandrel comprising a bottom plug portion, a top plug portion, a work string attachment portion, a first release portion between the bottom plug portion and the top plug portion, wherein the first release portion comprises a controlled strength segment configured to fail structurally and thereby release the bottom plug portion at a first fluid pressure, and a second release portion between the top plug portion and the work string attachment portion, wherein the second release portion is configured to release the bottom plug portion at a second fluid pressure, wherein the first fluid pressure is less than the second fluid pressure, a bottom plug body disposed about the bottom plug portion of the mandrel, and a top plug body disposed about the top plug portion of the mandrel, causing the first release portion to release the bottom plug portion by causing structural failure of the controlled strength segment, pumping a cementitious slurry via the flowbore of the casing, causing the second release portion to release the top plug portion, displacing the cementitious slurry from the flowbore of the casing into an annular space between the casing and a wellbore wall, and allowing the cementitious slurry to set.

Also disclosed herein is a wellbore servicing method comprising positioning a casing defining a flowbore within a wellbore with a subsurface release plug release apparatus disposed within a portion of the casing, the subsurface release plug release apparatus comprising a mandrel comprising a bottom plug portion, a top plug portion, a work string attachment portion, a first release portion between the bottom plug portion and the top plug portion, wherein the first release portion comprises a controlled strength segment configured to fail structurally and thereby release the bottom plug portion at a first fluid pressure, and a second release portion between the top plug portion and the work string attachment portion, wherein the second release portion is configured to release the top plug portion at a second fluid pressure, wherein the first fluid pressure is less than the second fluid pressure, a bottom plug body disposed about the bottom plug portion of the mandrel, and a top plug body disposed about the top plug portion of the mandrel, pumping a first obturating member to pass through the top plug portion of the mandrel and engage a first seat within the bottom plug portion of the mandrel, applying a fluid pressure to cause the first release portion to release the bottom plug portion by causing structural failure of the first controlled strength segment, pumping a second obturating member to engage a second seat within the top plug portion of the mandrel, and applying a fluid pressure to cause the second release portion to release the top plug portion.

DETAILED DESCRIPTION

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are one or more embodiments of a subsurface release plug (SRP) release apparatus, a SRP system, and methods using the same in the performance of a wellbore servicing operation. In an embodiment, such an SRP release apparatus or SRP system may be employed in the placement and cementing of a casing string within a wellbore.

Figure 1:
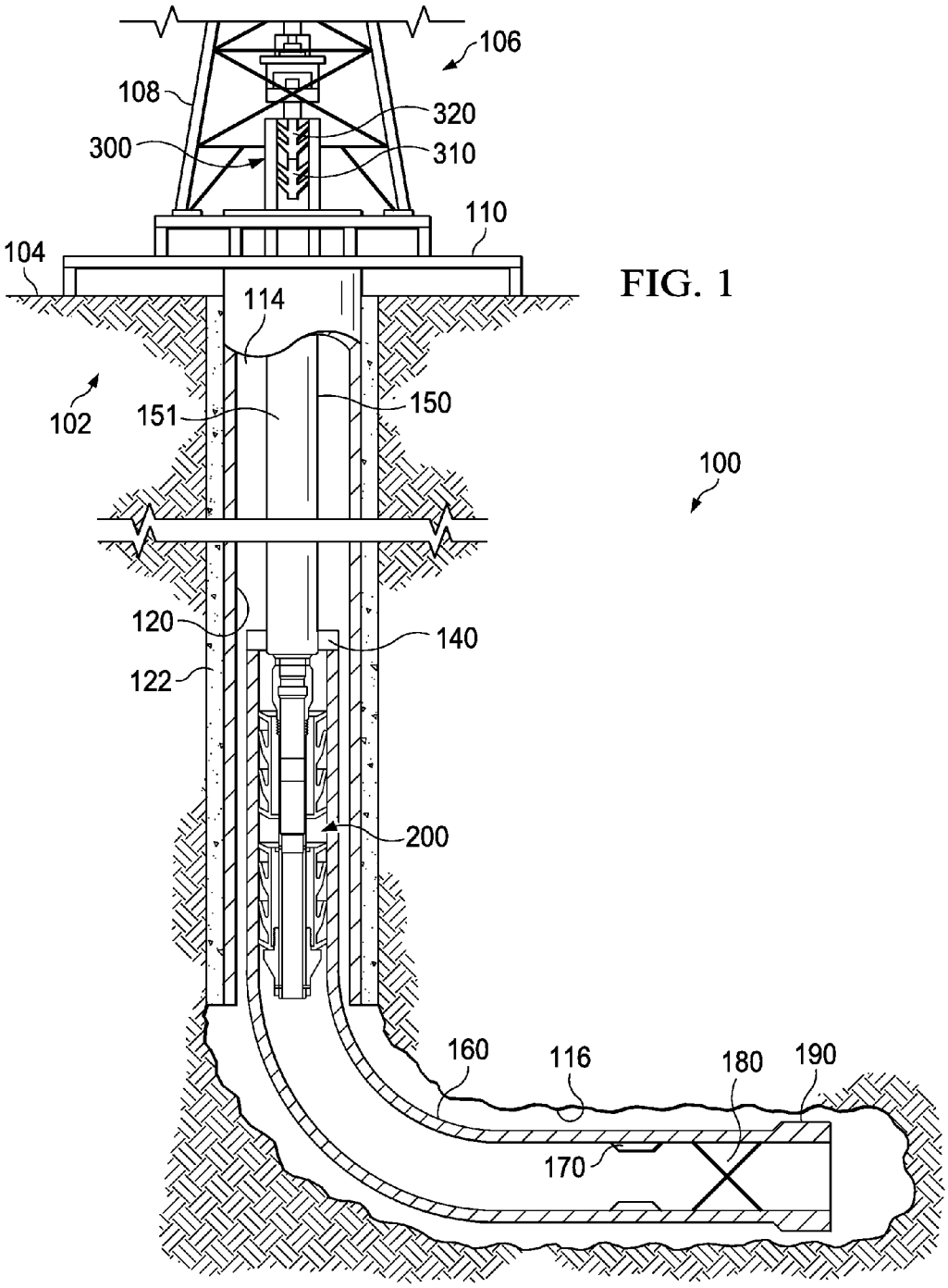
FIG. 1 is a cut-away illustration of an environment for a wellbore servicing operation.

Referring to FIG. 1, an embodiment of an operating environment in which an SRP release apparatus and/or system may be employed is illustrated. It is noted that although some of the figures may exemplify horizontal or vertical wellbores, the principles of the apparatuses, systems, and methods disclosed may be similarly applicable to horizontal wellbore configurations, conventional vertical wellbore configurations, and combinations thereof. Therefore, the horizontal or vertical nature of any figure is not to be construed as limiting the wellbore to any particular configuration.

As depicted in FIG. 1, the operating environment generally comprises a wellbore 114 that penetrates a subterranean formation 102 for the purpose of recovering hydrocarbons, storing hydrocarbons, disposing of carbon dioxide, or the like. The wellbore 114 may be drilled into the subterranean formation 102 using any suitable drilling technique. In an embodiment, a drilling or servicing rig comprises a derrick with a rig floor through which a work string 150 (e.g., a drill string, a tool string, a segmented tubing string, a jointed tubing string, or any other suitable conveyance, or combinations thereof) may be positioned within or partially within the wellbore 114. In an embodiment, the work string 150 may comprise two or more concentrically positioned strings of pipe or tubing (e.g., a first work string may be positioned within a second work string). The drilling or servicing rig may be conventional and may comprise a motor driven winch and other associated equipment for lowering the work string 150 into the wellbore 114. Alternatively, a mobile workover rig, a wellbore servicing unit (e.g., coiled tubing units), or the like may be used to lower the work string 150 into the wellbore 114.

The wellbore 114 may extend substantially vertically away from the earth's surface over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In embodiment, the wellbore 114 may be partially cased with a first casing string 120 and partially uncased. The first casing string 120 may be secured into position within the wellbore 114 in a conventional manner with cement 122, alternatively, the first casing string 120 may be partially cemented within the wellbore 120, alternatively, the first casing string may be uncemented. In an alternative embodiment, the wellbore 114 may be uncased and uncemented.

In the embodiment of FIG. 1, a second casing string 160 (hereinafter, casing 160) may be positioned within an uncased portion of the wellbore 116. The casing 160 may be lowered into the wellbore 114 and/or the uncased portion of the wellbore 116 suspended from the work string 150. In an embodiment, the casing 160 may be suspended from the work string 150 by a liner hanger 140 or the like. The liner hanger 140 may comprise any suitable type or configuration of liner hanger, as will be appreciated by one of skill in the art with the aid of this disclosure.

Figure 2A:
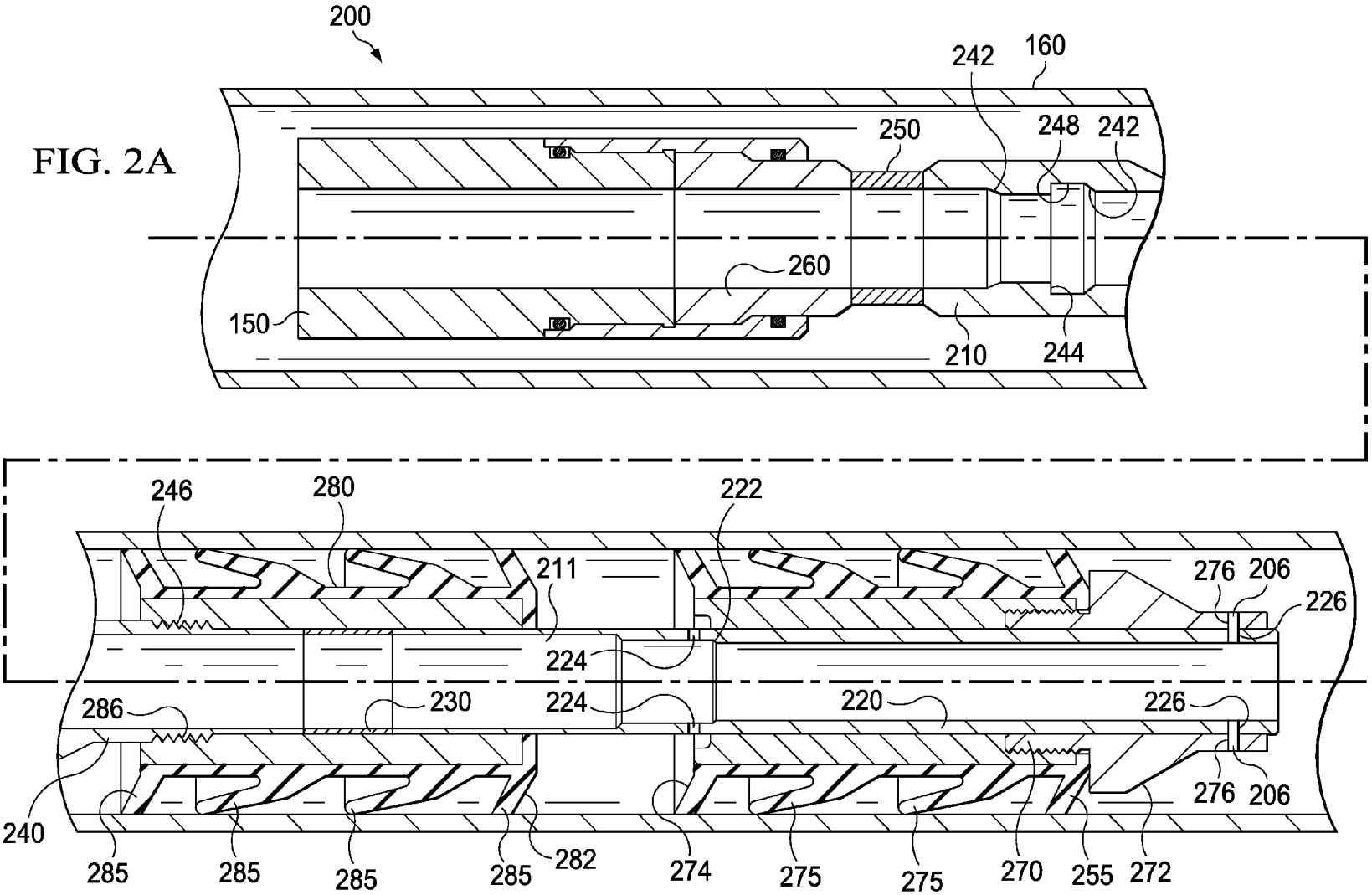
FIG. 2A is cross-sectional illustration of an embodiment of a subsurface release plug release apparatus.

In the embodiment of FIG. 1, a SRP release apparatus 200 is disposed at the lower end of the work string 150 and within an upper portion of the casing 160. Referring to FIG. 2A, an embodiment of the SRP release apparatus 200 is illustrated. In the embodiment of FIG. 2A, the SRP release apparatus 200 generally comprises a mandrel 210, a bottom plug body 270 disposed about a portion of the mandrel 210, and a top plug body 280 disposed about a portion of the mandrel 210.

In one or more of the embodiments disclosed herein, a SRP release apparatus such as SRP release apparatus 200 may be discussed with reference to one or more figures. In these figures, the illustrated embodiments of the SRP release apparatus are generally oriented such that the upper-most (i.e., the furthest up-hole) end or portion of the SRP release apparatus 200 may be toward the left-hand side of such figure while the lower-most (i.e., the further down-hole) end or portion of the SRP release apparatus 200 may be toward the right-hand side of the figure. It is noted that reference herein to an upper, upper-most, up-hole, lower, lower-most, or down-hole, portion, segment, and/or component should not be construed as so-limiting unless otherwise specified. While the embodiments of a SRP release apparatus may be illustrated in a given configuration or orientation, one of skill in the art with the aid of this disclosure will appreciate that a SRP release apparatus may be suitably otherwise configured or oriented.

In the embodiment of FIG. 2A, the mandrel 210 may be characterized as a generally tubular body defining an axial flowbore 211 having a longitudinal axis. The axial flowbore 211 may be in fluid communication with an axial flowbore 151 defined by the work string 150.

In the embodiment of FIG. 2A, the mandrel 210 comprises a bottom plug mandrel portion 220, a first controlled strength segment 230, a top plug mandrel portion 240, a second controlled strength segment 250, and a work string attachment portion 260. As used herein, a controlled strength segment refers to segment of the mandrel 210 having a strength in a predetermined, desirable threshold and which, when that threshold is exceeded, will fail structurally, thereby resulting in the longitudinal separation of the mandrel 210 at the controlled strength segment. For example, when subjected to a force (e.g., an internally applied fluid differential pressure) greater than the threshold of a controlled strength segment, the controlled strength segment may burst, crack, disintegrate, break, rupture, or the like. In various embodiments, a controlled strength segment may be characterized as exhibiting a strength that is comparatively greater, alternatively, about the same as, alternatively, less than the strength of another controlled strength segment, the remainder of the mandrel, or combinations thereof.

In an embodiment, the mandrel 210 may be characterized as comprising regions or segments having strengths that vary in comparison to each other. For example, the mandrel 210 may comprise two or more portions, regions, or segments exhibiting a relatively high strength. The mandrel 210 may also comprise one or more portions, regions, or segments exhibiting relatively intermediate strength in comparison to the high-strength portions. The mandrel 210 may also comprise one or more segments exhibiting relatively low strength in comparison to the intermediate strength portions. In the embodiment of FIG. 2A, the bottom plug mandrel portion 220, the top plug mandrel portion 240, and the work string attachment portion 260 may exhibit the relatively highest strength, the second controlled strength segment 250 may exhibit relatively low strength in comparison to the bottom plug mandrel portion 220, the top plug mandrel portion 240, and the work string attachment portion 260, and the first controlled strength segment 230 may exhibit relatively low strength in comparison to the second controlled strength segment 250.

In an embodiment, the mandrel 210 may be formed from a suitable material. Examples of materials from which the mandrel may be formed include but are not limited to composite materials (examples of which will be discussed herein), metals and metal alloys, phenolic materials, rubbers, hardened plastics, cast materials, ceramic materials, resins, epoxies, or combinations thereof. Composite materials may include a reinforcing agent and a matrix material. In a fiber-based composite, fibers may act as the reinforcing agent. The matrix material may act to keep the fibers in a desired location and orientation and also serve as a load-transfer medium between fibers within the composite. In an embodiment, the materials from which the mandrel 210 is formed may be characterized as drillable materials.

Figure 3A:
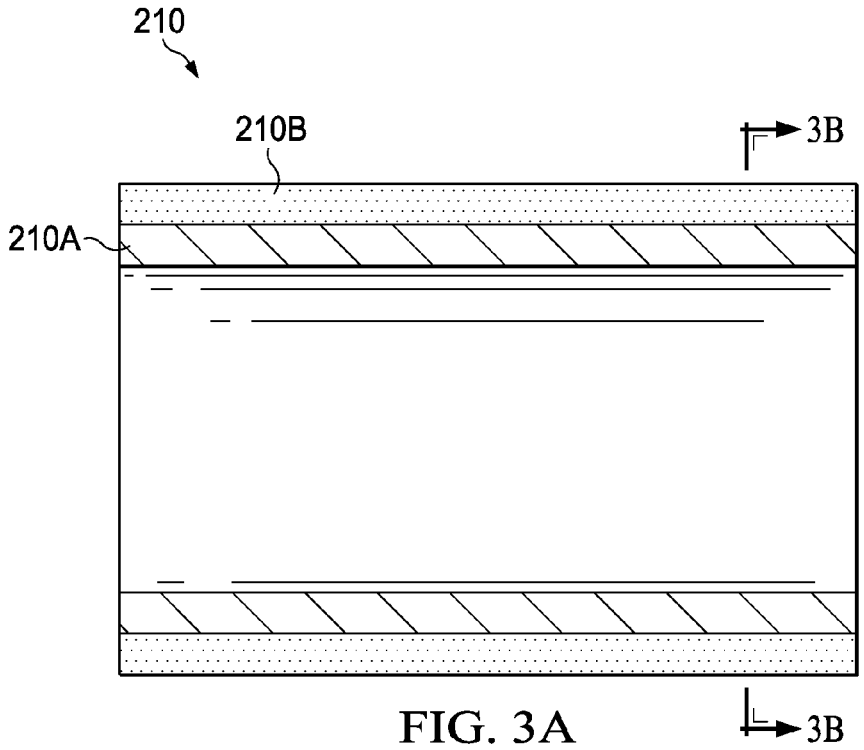
FIG. 3A is a cross-sectional longitudinal illustration of an embodiment of a mandrel of a subsurface release plug release apparatus.
Figure 3B:
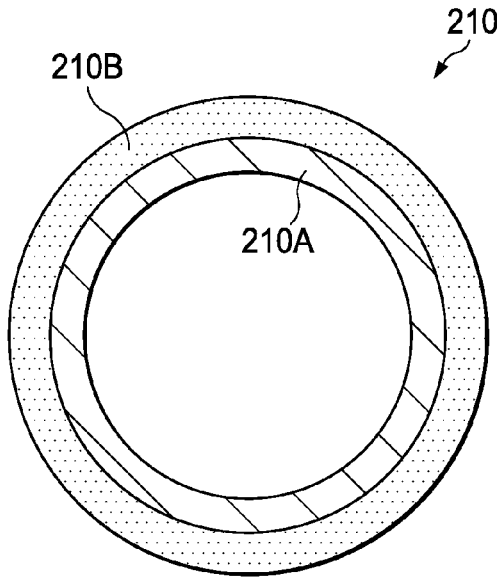
FIG. 3B is a cross-sectional end-view illustration of an embodiment of a mandrel of a subsurface release plug release apparatus.

In an embodiment, a mandrel having regions, portions, or segments having strengths that vary in comparison to each other, such as mandrel 210, comprises a fiber-wound composite formed by a fiber-winding process. Referring to FIGS. 3A and 3B, a fiber-wound mandrel 210 comprising a composite 210B of fibers a binder wound about a template or spindle 210A, is illustrated in a side-view of the pipe and an end-view, respectively. The spindle 210A may comprise a generally tubular body constructed of conventional metal alloys (e.g., steel, such as X65 or X70), cast materials, ceramic materials, resins, epoxies, or combinations thereof. The fibers may comprise assemblies of strings (e.g., windings, mats, meshes, etc.), each string consisting of multiple, intertwined threads. These threads may be synthetic (e.g., Kevlar™), metal alloys (e.g., steel), fiberglass, carbon fiber, nano-fibers, or combinations thereof.

The binder surrounds and/or permeates the fibers. Suitable binder materials that may be used in the composite materials described herein may include, but are not limited to, thermosetting resins including orthophthalic polyesters, isophthalic polyesters, phthalic/maelic type polyesters, vinyl esters, thermosetting epoxies, phenolics, cyanates, bismaleimides, nadic end-capped polyimides (e.g., PMR-15), and any combinations thereof. Additional resin matrix materials may include thermoplastic resins including polysulfones, polyamides, polycarbonates, polyphenylene oxides, polysulfides, polyether ether ketones, polyether sulfones, polyamide-imides, polyetherimides, polyimides, polyarylates, liquid crystalline polyester, polyurethanes, polyureas, and any combinations thereof. In an embodiment, the binder material may comprise a two-component resin composition. Suitable two-component resin materials may include a hardenable resin and a hardening agent that, when combined, react to form a cured resin matrix material. Suitable hardenable resins that may be used include, but are not limited to, organic resins such as bisphenol A diglycidyl ether resins, butoxymethyl butyl glycidyl ether resins, bisphenol A-epichlorohydrin resins, bisphenol F resins, polyepoxide resins, novolak resins, polyester resins, phenol-aldehyde resins, urea-aldehyde resins, furan resins, urethane resins, glycidyl ether resins, other epoxide resins, and any combinations thereof. Suitable hardening agents that can be used include, but are not limited to, cyclo-aliphatic amines; aromatic amines; aliphatic amines; imidazole; pyrazole; pyrazine; pyrimidine; pyridazine; 1H-indazole; purine; phthalazine; naphthyridine; quinoxaline; quinazoline; phenazine; imidazolidine; cinnoline; imidazoline; 1,3,5-triazine; thiazole; pteridine; indazole; amines; polyamines; amides; polyamides; 2-ethyl-4-methyl imidazole; and any combinations thereof. In an embodiment, one or more additional components may be added the matrix material to affect the properties of the matrix material. For example, one or more elastomeric components (e.g., nitrile rubber) may be added to increase the flexibility of the resulting matrix material. Not intending to be bound by theory, the binder may act to hold the fibers together and retain the fibers in the desired orientation. In addition, the binder may protect the fibers. One skilled in the art may readily appreciate that the thickness and/or percentage of the binder may varied to meet a desired parameter.

In an embodiment, the mandrel 210 may be manufactured by a method comprising passing the fibers through a bath or solution of the binder solution and wrapping the binder-wetted fibers around the spindle 210A using a fiber wrapping machine or other similar apparatus, as will be appreciated by one of skill in the art viewing this disclosure. In an embodiment, the fibers may be wound via an automated or computed-driven machine, for example, as may be capable of winding the fibers to achieve one or more desired strength parameters or characteristics for the completed mandrel 210, as will be described herein. This step in the manufacturing process may be performed in a manufacturing shop or other similar facility. The spindle 210A may be secured at both ends and rotated as the fibers are wrapped around or otherwise applied about the spindle 210A from one end to the other and back again, continuing in a winding fashion until the fibers have been applied in the desired thickness and/or number of windings. In an embodiment, the fibers may be wound about the spindle 210A in alternating "hoop" and "helical" layers, where hoop layers refer to fibers wound circumferentially about the spindle 210A generally perpendicularly to longitudinal axis of the mandrel 210 and helical layers refer to fibers applied generally axially with respect to the longitudinal axis of the mandrel 210.

In an embodiment, one or more desired strength parameters or characteristics for the completed mandrel 210 may be designed and imparted dependent upon the way in which the fibers are applied to the spindle 210A at various positions or regions along the mandrel, for example, the number of windings of fibers wound around the spindle 210A, the direction and/or orientation of the fibers, the thickness of the composite 210B, or combinations thereof. For example, various strength characteristics and/or other mechanical properties may be adjusted by varying the winding angle of the fibers, altering the type and/or characteristics of the fiber material and/or the binder materials employed, or combinations thereof. As such, it is possible to manufacture mandrels having strength characteristics that vary at different portions or segments along the mandrel 210 by ranging the winding angle from about 0° to about −20° with respect to the longitudinal axis of the mandrel 210, altering the type of fiber, altering the thickness of the individual fibers, altering the thickness in which the fibers are applied, or combinations thereof. In an embodiment, to achieve the regions of varying strength, the fibers may be wound around the spindle 210A in a first orientation and/or thickness in a first region and a second orientation and/or thickness in a second region, thereby imparting differing strength parameters or characteristics to differing regions of the mandrel 210. For example, a relatively high strength portion of the mandrel may be wound with high strength carbon fibers and a relatively low strength portion of the mandrel may be wound with a lower strength fiber such as glass fibers. For example, the bias angle, the fiber type, fiber diameter, or combinations thereof may be varied to create areas along the mandrel having specific strength properties.

In an alternative embodiment, a mandrel like mandrel 210 having regions, portions, or segments having strengths that vary in comparison to each other may be manufactured by a milling process. In such an embodiment the mandrel 210 may be milled to comprise portions having one or more relatively reduced strength characteristics. For example, the mandrel 210 may comprise portions of reduced thickness, perforations, or other induced points of weakness, as will be appreciated by one of skill in the art viewing this disclosure.

In an embodiment, the mandrel 210, particularly, the work string attachment mandrel portion 260, may be configured to be connected to the lower end of the work string 150 via a suitable connection, for example, a threaded connection, a hammer joint, a collet, the like, or combinations thereof.

In an embodiment, the bottom plug mandrel portion 220 may be configured to receive and engage an obturating member (e.g., a dart or ball, as will be discussed herein). For example, the inner bore of the bottom plug mandrel portion 220 may comprise one or more seats comprising a shoulder, a chamfer, a bevel, or a similar reduction in the diameter of the inner bore surface that will receive and engage an obturating member of a given size and/or configuration. In the embodiment of FIG. 2A the inner bore of the bottom plug mandrel portion 220 may comprises two chamfers 222 extending between a greater inner bore diameter and a lesser inner bore diameter.

In an embodiment, the bottom plug mandrel portion 220 may be configured to allow pressure equalization between the axial flowbore 211 and the exterior of the mandrel 210. In the embodiment of FIG. 2A, the bottom plug mandrel portion 220 comprises ports 224 allowing for the communication of fluid between the axial flowbore 211 and the exterior of the mandrel 210.

In an embodiment, the bottom plug mandrel portion 220 may be configured to be releasably secured to the bottom plug body 270 or vice versa. For example, the bottom plug mandrel portion 220 may comprise a groove or channel configured to receive a snap-ring, a bore configured to receive a shear pin or other frangible member, or the like. In the embodiment of FIG. 2A, the bottom plug mandrel portion 220 comprises a bore 226 configured to receive a the pin or other frangible member and releasably restrict movement of the bottom plug body 270 with respect to the bottom plug mandrel portion 220, as will be discussed herein.

In an embodiment, the top plug mandrel portion 240 may be configured to receive and engage an obturating member (e.g., a dart or ball, as will be discussed herein). For example, the inner bore of the top plug mandrel portion 240 may comprise one or more seats comprising a shoulder, a chamfer, a bevel, or a similar reduction in the diameter of the inner bore surface that will receive and engage an obturating member of a given size and/or configuration. In the embodiment of FIG. 2A the inner bore of the top plug mandrel portion 240 comprises two chamfers 242 extending between a greater inner bore diameter and a lesser inner bore diameter.

In an embodiment, the top plug mandrel portion 240 may be configured to secure such an obturating member (e.g., a dart or ball, as will be discussed herein) that engages the seat (e.g., chamfers 242) within the inner bore of the top plug mandrel portion 240. For example, the top plug mandrel portion 240 may comprise one or more recesses, grooves, shoulders, or channels configured to receive an expandable ring, a latch, a snap-ring, a pin, or the like associated with the obturating member. Alternatively, the top plug mandrel portion 240 may comprise a latch, a snap-ring, a pin, or combinations thereof to engage a groove and/or recess of an obturating member. In the embodiment of FIG. 2A, the top plug mandrel portion 240 comprises a shoulder 244 at the upper end of a recess 248 that is configured to receive an expandable ring or the like and secure an obturating member that engages the seat within the inner bore of the top plug mandrel portion 240.

In an embodiment, the top plug mandrel portion 240 may be configured to engage and be secured to the top plug body 280. For example, the top plug mandrel portion 240 may comprise a series of shoulders or bevels, a series of threads, a groove or channel configured to receive a snap-ring, a bore configured to receive a pin, or combinations thereof associated with the top plug body 230 (or vice versa). In the embodiment of FIG. 2A, the top plug mandrel portion 240 comprises a threaded interface 246 along the outer surface thereof configured to engage a complementary threaded interface of the top plug body 280 and restrict movement of the top plug mandrel portion 240 with respect to the top plug body 280, as will be discussed herein.

In the embodiment of FIG. 2A, the first controlled strength segment 230 may extend circumferentially around the mandrel 210 over a given longitudinal distance. The first control strength segment 230 may be longitudinally disposed along the mandrel between the bottom plug mandrel portion 220 and the top plug mandrel portion 240.

In an embodiment, the first controlled strength segment 230 may be characterized as exhibiting a strength, particularly, a tensile strength, less than the second controlled strength segment 250 and less than the body of the mandrel 210. In such an embodiment, the first controlled strength segment 230 may fail structurally when subjected to an internally applied fluid differential pressure greater than a given threshold while the second strength segment 250 and the body of the mandrel 210 will not. In an embodiment, the first controlled strength segment 230 may be characterized as having a predetermined tensile strength (referring to the amount of force applied in opposing directions along the longitudinal axis of the mandrel 210) that the first controlled strength segment is able to withstand. For example, the first controlled strength segment 230 may fail, causing the mandrel 210 to separate longitudinally, upon application of an internally applied fluid differential pressure greater than a given threshold. In an embodiment, such a threshold may be in the range of from about 800 psi to about 2,500 psi, alternatively, from about 1,000 psi to about 2,000 psi.

In the embodiment of FIG. 2A, the second controlled strength segment 250 may extend circumferentially around the mandrel 210 over a given longitudinal distance. The second controlled strength segment 250 may be longitudinally disposed along the mandrel between the top plug mandrel portion 240 and the work string attachment mandrel portion 260

In an embodiment, the second controlled strength segment 250 may be characterized as exhibiting a strength, particularly, a tensile strength, greater than the first controlled strength segment 230 and less than the body of the mandrel 210. In such an embodiment, the second controlled strength segment 250 may fail structurally when subjected to an internally applied fluid differential pressure greater than a given threshold while the body of the mandrel 210 will not. In an embodiment, the second controlled strength segment 250 may be characterized as having a predetermined tensile strength (referring to the amount of force applied in opposing directions along the longitudinal axis of the mandrel 210) that the first controlled strength segment is able to withstand. For example, the second controlled strength segment 250 may fail, causing the mandrel 210 to separate longitudinally, upon application of an internally applied fluid pressure greater than a given threshold. In an embodiment, such a threshold may be in the range of from about 1,500 psi to about 5,500 psi, alternatively, from about 3,000 psi to about 4,000 psi.

Figure 2B:
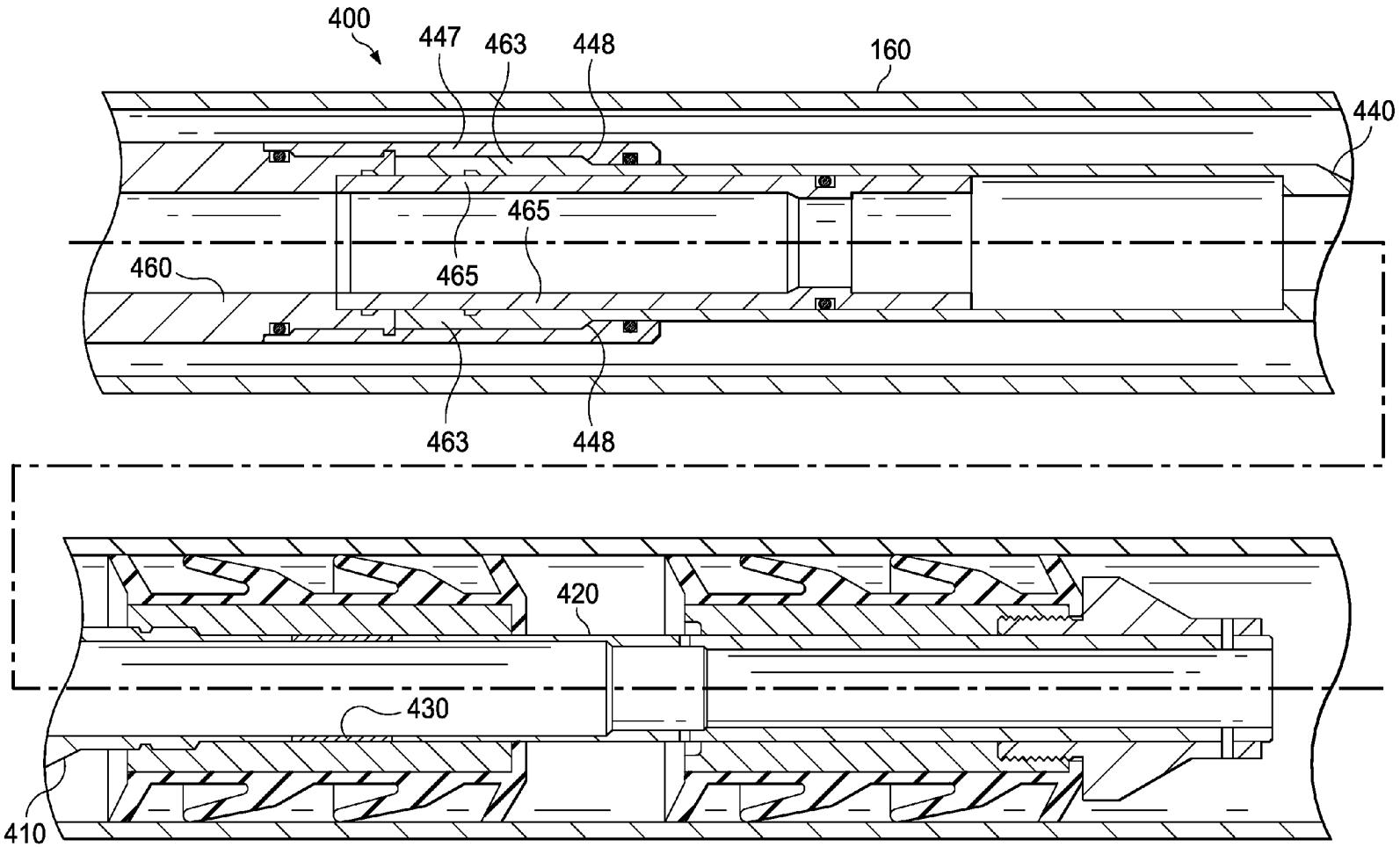
FIG. 2B is cross-sectional illustration of an alternative embodiment of a subsurface release plug release apparatus.

Referring to FIG. 2B, an alternative embodiment of an SRP release apparatus 400 comprising an alternative configuration of a mandrel 410 is illustrated. In the embodiment of FIG. 2B, the mandrel 410 comprises a bottom plug mandrel portion 420, a first controlled strength segment 430, a top plug mandrel portion 440 comprising a plurality of collet fingers 463 and a collet releasing sleeve 465, and a work string attachment portion 460 comprising a collet retainer sleeve 447.

In the embodiment of FIG. 2B, the mandrel 410 comprises regions or segments having strengths that vary in comparison to each other. For example, in the embodiment of FIG. 2B, the bottom plug mandrel portion 420, the top plug mandrel portion 440, and the work string attachment portion 460 may exhibit the relatively highest strength and the first controlled strength segment 430 may exhibit relatively low strength in comparison to the bottom plug mandrel portion 420, the top plug mandrel portion 440, and the work string attachment portion 460. In the embodiment of FIG. 2B, the bottom plug mandrel portion 420, the first controlled strength segment 430, the top plug mandrel portion 440 and the work string attachment portion 460 may be similarly configurable and similarly operable as disclosed herein (e.g., as discussed with reference to the Figures, including but not limited to FIG. 1).

In the embodiment of FIG. 2B, the top plug mandrel portion 440 may be configured to be connected to the work string attachment portion 460. For example, in the embodiment of FIG. 2B, the work string attachment portion 460 comprises a collet retainer sleeve 447 having a shoulder 448 or the like. Also, in the embodiment of FIG. 2B, the top plug mandrel portion 440 comprises a plurality of collet fingers 463. The collet fingers 463 may be configured to engage the shoulder 448 in a radially-expanded conformation and to disengage the shoulder 448 in a radially contracted or collapsed conformation. In the embodiment of FIG. 2B, the collet fingers 463 are held in the radially-expanded conformation by a collet releasing sleeve 465, thereby retaining the top plug mandrel portion 440 with respect to the work string attachment portion 460. In an embodiment, the collet releasing sleeve 465 may be longitudinally slidable between a first, relatively upper position, as shown in FIG. 2B, and a second, relatively lower position. In an embodiment, the collet releasing sleeve 465 may be retained in the first, relatively upper position by a frangible member, such as a shear pin or the like.

Referring again to FIG. 2A, in an embodiment the bottom plug body 270 generally comprises a tubular body defining a bore extending longitudinally therethrough. As shown in FIG. 2A, the bottom plug body 270 may be configured to receive the bottom plug mandrel portion 220, which may be positioned within the bore defined by the bottom plug body 270. In the embodiment of FIG. 2A, the bottom plug body 270 may be releasably secured to the bottom plug mandrel portion 220. For example, the bottom plug body 270 may comprise a groove or channel configured to receive a snap-ring, a bore configured to receive a shear pin or other frangible member, or the like. In the embodiment of FIG. 2A, the bottom plug body 270 comprises a bore 276 configured to receive a frangible member, particularly, shear pin 206 which releasably restricts movement of the bottom plug body 270 with respect to the bottom plug mandrel portion 220. In an embodiment, the force necessary to cause structural failure of the shear pin 206 may be greater than, alternatively, less than, the force necessary to cause structural failure of the first controlled strength segment 230.

In an alternative embodiment, the bottom plug body 270 may be connected to the bottom plug mandrel portion 220 by a controlled strength area within the bottom plug body 270, a glue joint having a predetermined strength, a shouldered butt joint having a predetermined strength, or the like.

In an embodiment, the bottom plug body 270 may be configured to sealably engage an inner wall of a casing string, such as, casing 160. For example, in the embodiment of FIG. 2A, the bottom plug body 270 further comprises one or more wipers 275. In an embodiment, the wipers 275 may generally be configured to substantially remove, separate, or clean fluids from the inner bore surface of the casing 160. The wipers 275 may be provided in a suitable number and configuration, as will be appreciated by one of skill in the art viewing this disclosure. For example, the embodiment of FIG. 2A illustrates the bottom plug body 270 with four wipers, however more or fewer may be provided. The wipers 275 may extend radially outward from the bottom plug body 270. As will be appreciated by one of skill in the art viewing this disclosure, the wipers 275 may be sized to sealably and slidably engage the inner bore of a casing string such as casing 160 of a particular size. The wipers 275 may extend outward from the bottom plug body at a suitable angle from the bottom plug body 270. For example, in the embodiment of the FIG. 2A, each of the four wipers 275 is angled, thereby forming a conical, cross-section. In an embodiment, the wipers 275 may be formed from a suitable material. Such a suitable material may be characterized as conformable or pliable, for example, such that the wipers 275 may be able to conform to inconsistencies in the inner bore of the casing 160. Examples of suitable materials include but are not limited to rubber, foam, plastics, or combinations thereof.

In an embodiment, the bottom plug body 270 may be configured to engage a collar disposed within the casing 160, for example, a baffle adapter or landing collar such as landing collar 170, as will be discussed herein. For example, in the embodiment of FIG. 2A, the bottom plug body 270 comprises a nose portion having an angled face such as a chamfer 272. Chamfer 272 may be configured to sealably engage a seat comprising a complementary bevel or chamfer within the collar 170, as will be discussed herein.

In an embodiment, the bottom plug body 270 may be configured to receive and engage the top plug body 280, as will be discussed herein. For example, in the embodiment of FIG. 2A the bottom plug body 270 comprises an upper chamfer 274 configured to receive and engage a complementary chamfer of the top plug body 280.

In an embodiment, the top plug body 280 generally comprises a tubular body defining a bore extending longitudinally therethrough. As shown in FIG. 2A, the top plug body 280 may be configured to receive the top plug mandrel portion 240, which may be positioned within the bore defined by the top plug body 280. In the embodiment of FIG. 2A, the top plug body 280 may be secured to top plug mandrel portion 240. For example, the top plug body 280 may comprise a series of shoulders or bevels, a series of threads, a groove or channel configured to receive a snap-ring, a bore configured to receive a pin, or combinations thereof (or vice versa). In the embodiment of FIG. 2A, the top plug body 280 comprises a threaded interface 286 along the inner surface thereof configured to engage the complementary threaded interface 246 of the top plug mandrel portion 280 and restrict movement of the top plug body 280 with respect to the top plug mandrel portion 240, as will be discussed herein.

In an embodiment, the top plug body 280 may be configured to sealably engage an inner wall of a casing string, for example, casing 160. For example, in the embodiment of FIG. 2A, the top plug body 280 further comprises one or more wipers 285. In an embodiment, the wipers 285 may generally be configured to substantially remove, separate, or clean fluids from the inner bore surface of the casing 160. The wipers 285 may be provided in a suitable number and configuration, as will be appreciated by one of skill in the art viewing this disclosure. For example, the embodiment of FIG. 2A illustrates the top plug body 280 with four wipers, however more or fewer may be provided. The wipers 285 may extend radially outward from the top plug body 280. As will be appreciated by one of skill in the art viewing this disclosure, the wipers 285 may be sized to sealably and slidably engage the inner bore of a casing string such as casing 160 of a particular size. The wipers 285 may extend outward from the bottom plug body at a suitable angle from the top plug body 280. For example, in the embodiment of the FIG. 2A, each of the four wipers 285 is angled, thereby forming a conical, cross-section. In an embodiment, the wipers 285 may be formed from a suitable material. Such a suitable material may be characterized as conformable or pliable, for example, such that the wipers 285 may be able to conform to inconsistencies in the inner bore of the casing 160. Examples of suitable materials include but are not limited to rubber, foam, plastics, or combinations thereof.

In an embodiment, the top plug body 280 may be configured to engage the bottom plug, as will be discussed herein. For example, in the embodiment of FIG. 2A, the top plug body 280 comprises a chamfer 282 configured to engage chamfer 274 of the bottom plug body 270.

Referring again to FIG. 1, an embodiment of a SRP system 100 is illustrated. In the embodiment of FIG. 1, the SRP system 100 generally comprises the SRP release apparatus 200, a bottom plug launching member 310, a top plug launching member 320, and a landing collar 170. In an embodiment, the SRP system 100 optionally comprises a one-way valve 180 and/or a shoe 190, which may or may not contain a float valve as well. In the embodiment of FIG. 1, the bottom plug launching member 310, the top plug launching member 320, or both, may be deployed from a dart-launching apparatus 300 located at the surface 104, as will be appreciated by one of skill in the art viewing this disclosure.

Figure 4A:
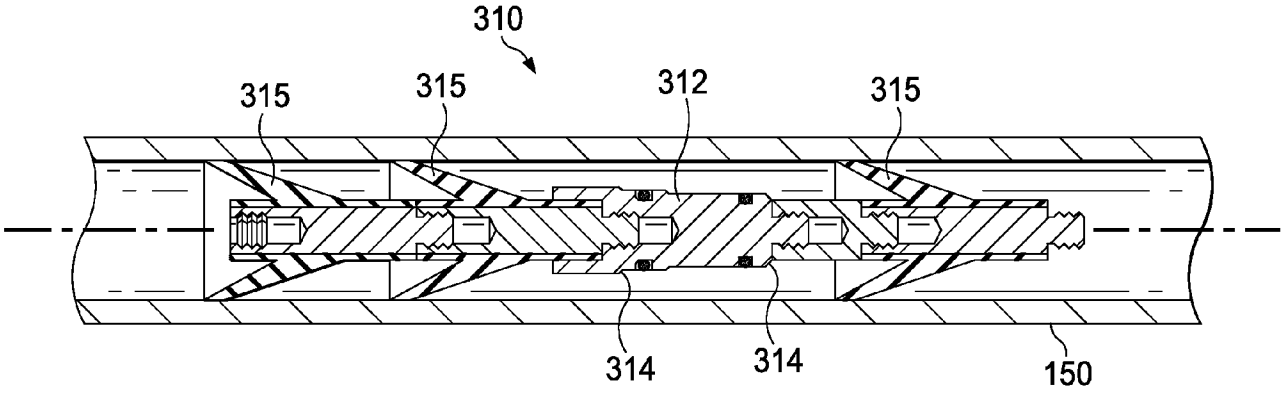
FIG. 4A is a cross-sectional illustration of an embodiment of a bottom plug releasing member disposed within a work string.

Referring to FIG. 4A, an embodiment of a bottom plug launching member 310 is illustrated. In an embodiment, the bottom plug launching member 310 may be generally configured to sealably engage a seat or landing within the bottom plug mandrel portion 220 and thereby restrict, block, or substantially restrict the passage of fluid. In the embodiment of FIG. 4A, the bottom plug launching member 310 comprises a dart. The bottom plug launching member 310 generally comprises a longitudinal body 312 and one or more wipers 315.

In an embodiment, the longitudinal body 312 may be characterized as a shaft or mandrel. The longitudinal body 312 may be any suitable size, as will be appreciated by one of skill in the art viewing this disclosure. The longitudinal body 312 may be formed from a single piece, alternatively, the longitudinal body 312 may be formed from multiple operably-connected components (e.g., a plurality of body portions or segments connected by a threaded connection or the like).

In an embodiment, the wipers 315 may be configured to sealably engage an inner wall of the work string 150 and/or the inner walls of the mandrel 210 of the SRP release apparatus 200. The wipers 315 may be provided in a suitable number and configuration, as will be appreciated by one of skill in the art viewing this disclosure. For example, the embodiment of FIG. 4A illustrates the bottom plug launching member 310 with three wipers, however, more or fewer may be provided. The wipers 315 may extend radially outward from the bottom plug launching member 310. As will be appreciated by one of skill in the art viewing this disclosure, the wipers 315 may be sized to sealably and slidably engage the inner bore of a work string such as work string 150 of a particular size. The wipers 315 may extend outward from the longitudinal body 312 at a suitable angle. For example, in the embodiment of the FIG. 4A, each of the three wipers 315 is angled, thereby forming a conical, cross-section. In an embodiment, the wipers 315 may be formed form a suitable material. Such a suitable material may be characterized as conformable or pliable, for example, such that the wipers 315 may be able to conform to inconsistencies in the inner bore of the work string 150. Examples of suitable materials include but are not limited to rubber, foam, plastics, or combinations thereof.

In an embodiment, the bottom plug launching member 310 may be configured to engage and be retained within the bottom plug mandrel portion 220. For example, in the embodiment of FIG. 4A, the bottom plug launching member 310 comprises one or more surfaces (e.g., chamfers 314) configured to engage one or more of the complementary surfaces (e.g., chamfers 222) within the bottom plug mandrel portion 220 and thereby be retained within the bottom plug mandrel portion 220.

Figure 4B:
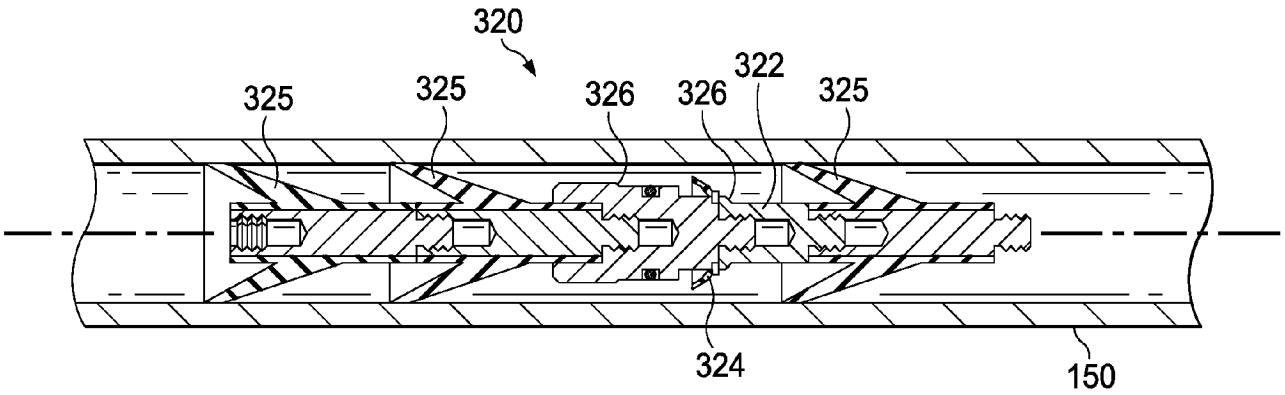
FIG. 4B is a cross-sectional illustration of an embodiment of a top plug releasing member disposed within a work string.

Referring to FIG. 4B, an embodiment of a top plug launching member 320 is illustrated. In an embodiment, the top plug launching member 320 may be generally configured to sealably engage a seat or landing within the top plug mandrel portion 240 and thereby restrict, block, or substantially restrict the passage of fluid. In the embodiment of FIG. 4B, the top plug launching member 320 comprises a dart. The top plug launching member 320 generally comprises a longitudinal body 322, one or more wipers 325, and an expandable ring 324.

In an embodiment, the longitudinal body 322 may be characterized as a shaft or mandrel. The longitudinal body 322 may be any suitable size, as will be appreciated by one of skill in the art viewing this disclosure. The longitudinal body 322 may be formed from a single piece, alternatively, the longitudinal body 322 may be formed from multiple operably-connected components (e.g., a plurality of body portions or segments connected by a threaded connection or the like).

In an embodiment, the wipers 325 may be configured to sealably engage an inner wall of the work string 150 and/or the inner walls of the mandrel 210 of the SRP release apparatus 200. The wipers 325 may be provided in a suitable number and configuration, as will be appreciated by one of skill in the art viewing this disclosure. For example, the embodiment of FIG. 4B illustrates the top plug launching member 320 with three wipers, however, more or fewer may be provided. The wipers 325 may extend radially outward from the bottom plug launching member 320. As will be appreciated by one of skill in the art viewing this disclosure, the wipers 325 may be sized to sealably and slidably engage the inner bore of a work string such as work string 150 of a particular size. The wipers 325 may extend outward from the longitudinal body 322 at a suitable angle. For example, in the embodiment of the FIG. 4B, each of the three wipers 325 is angled, thereby forming a conical, cross-section. In an embodiment, the wipers 325 may be formed form a suitable material. Such a suitable material may be characterized as conformable or pliable, for example, such that the wipers 325 may be able to conform to inconsistencies in the inner bore of the work string 150. Examples of suitable materials include but are not limited to rubber, foam, plastics, or combinations thereof.

In an embodiment, the top plug launching member 320 may be configured to engage and be retained within the top plug mandrel portion 240. For example, in the embodiment of FIG. 4B, the top plug launching member 320 comprises one or more surfaces (e.g., chamfers 326) configured to engage one or more of the complementary surfaces (e.g., chamfers 242) within the top plug mandrel portion 240 and thereby be retained within the top plug mandrel portion 240.

In an embodiment, the top plug launching member 320 may be configured to lock within the top plug mandrel portion 240. For example, in the embodiment of FIG. 4B, the top plug launching member 320 comprises an expandable ring 324 configured to expand into a complementary recess, slot, or groove within the top plug mandrel portion 240. The expandable ring 324 may be configured to expand into recess 248. in the top plug mandrel portion 240 and, when expanded, to interact with shoulder 244 to thereby prohibit the top plug launching member 320 from moving upward relative to the top plug mandrel portion 240 after the top plug launching member has engaged with the top plug mandrel portion 240, for example, engaging a seat surface or landing such as chamfers 242.

Figure 5:
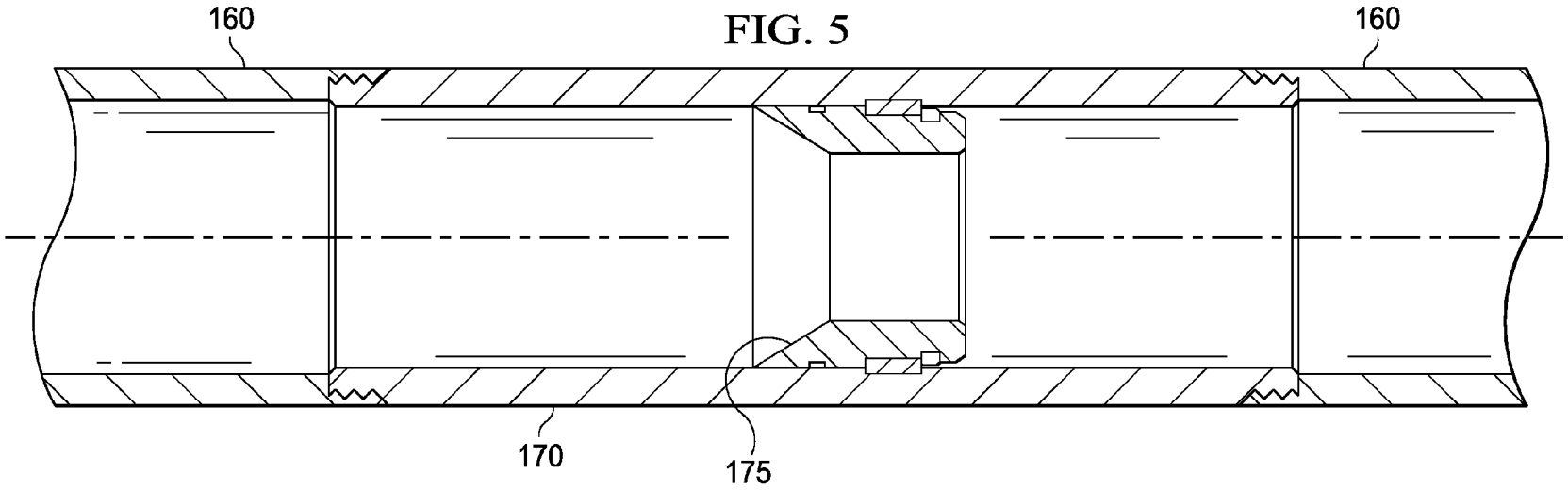
FIG. 5 is a cross-sectional illustration of an embodiment of a collar integrated within a casing.

In the embodiment of FIG. 1, the collar 170 may be configured to engage and retain the bottom plug body 270. Suitable examples of such a collar include a baffle adapter and/or a landing collar, as will be discussed in greater detail herein. Referring to FIG. 5, an embodiment of the collar 170 is illustrated. In the embodiment of FIG. 5, the collar 170 comprises a seat 175 comprising a surface (e.g., a chamfer) at a reduction in the diameter of the inner bore surface that will receive and engage, and thereby retain, the bottom plug body 270 (e.g., a complementary chamfer thereof). The collar 170 may be integrated within the casing 160 and positioned upward from the one-way valve 180 a desired distance (e.g., a shoe track).

In the embodiment of FIG. 1, the casing 160 comprises a one-way valve 180, for example, a float valve, check valve, and/or flapper valve configured to allow fluid movement downward through the casing and restrict fluid movement upward through the casing. The one-way valve 180 may be integrated within the casing 160 and positioned upward from the shoe 190. In an additional embodiment, the casing 160 may further comprise a bypass baffle above the one-way valve. A suitable bypass baffle is disclosed in U.S. Pat. No. 7,182,135, which is incorporated by reference herein in its entirety.

In the embodiment of FIG. 1, the casing 160 may comprise a shoe 190, for example, a guide shoe or float shoe, as will be appreciated by one of skill in the art viewing this disclosure. The shoe 190 may be integrated within the casing 160 and positioned at the downhole terminal end of the casing 160.

Also disclosed herein are one or more wellbore servicing methods employing an SRP release apparatus like SRP release apparatus 200 or 400 disclosed herein and/or an SRP system like SRP system 100 disclosed herein. In an embodiment, the SRP release apparatus 200 or 400 and/or the SRP system 100 may be employed in the performance of a cementing operation.

In an embodiment, a wellbore servicing method employing the SRP release apparatus and/or the SRP system may generally include the steps of positioning the SRP release apparatus within a casing string within a wellbore, releasing the bottom plug, circulating a cementitious slurry, releasing the top plug, displacing the at least a portion of the cementitious slurry into an annualar space, and allowing the cementitious slurry to set. In an embodiment, a wellbore servicing method may additionally and optionally include the step of removing the top plug and/or the bottom plug from the casing string.

In an embodiment, positioning the SRP release apparatus 200, 400 within a casing string within a wellbore may comprise positioning a casing string such as casing 160 within the wellbore 114 while attached to the downhole terminal end of a work string such as work string 150. For example, as disclosed above, the casing 160 may be attached to the work string 150 via a liner hanger. The SRP release apparatus 200 may be attached to the work string 150 within a generally upper portion of the casing 160 and, as such, may be lowered into the wellbore 114 with the casing 160.

Figure 6:
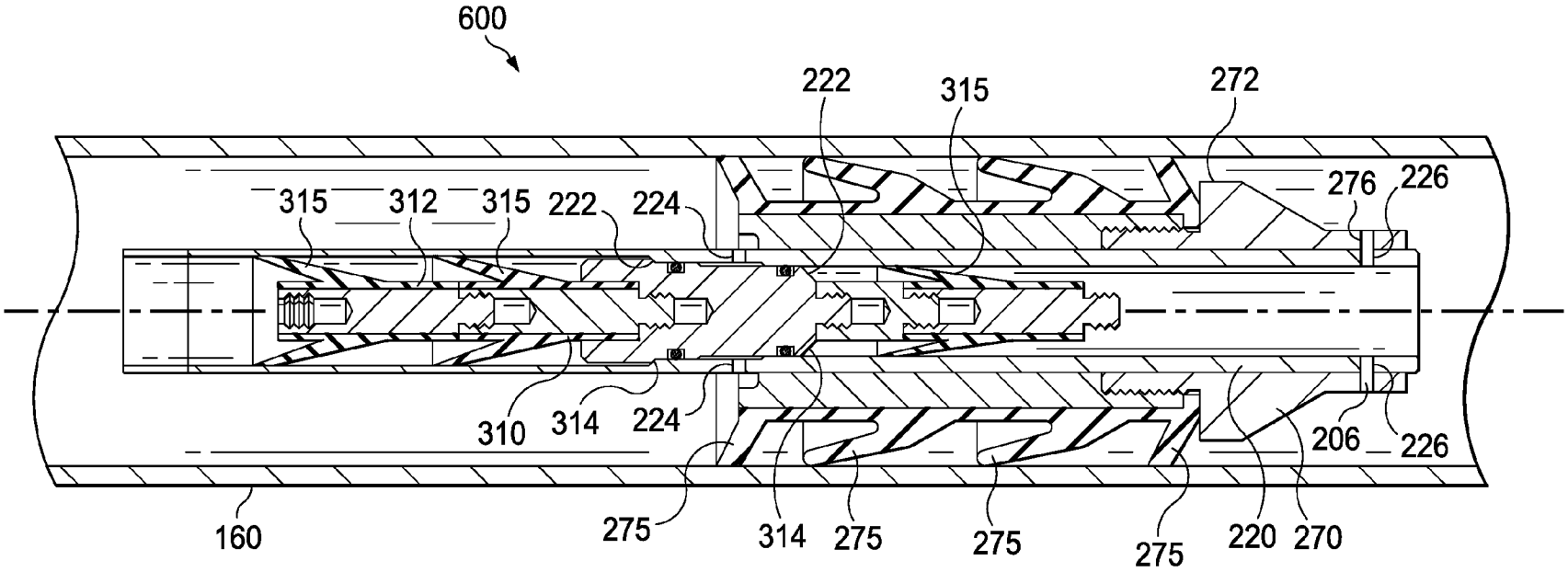
FIG. 6 is a cross-sectional illustration of an embodiment of a bottom plug separated from a subsurface release plug (SRP) release apparatus and disposed within a casing.

In an embodiment, releasing the bottom plug may generally comprise causing structural failure of the first controlled strength segment 230. In an embodiment, causing structural failure of the first controlled strength segment 230 may comprise deploying the bottom plug launching member 310 (e.g., via the operation of the dart-launching apparatus 300 located at the surface 104) and pumping the bottom plug launching member 310 downhole via the interior of the work string 150 to engage the seat within the bottom plug mandrel portion 220, as illustrated in FIG. 6. In the embodiment of FIG. 6, the chamfers 314 of the bottom plug launching member 310 engage the chamfers 222 within the bottom plug mandrel portion 220, thereby prohibiting the bottom plug launching member 310 from moving further downhole.

In an embodiment, after the bottom plug launching member 310 has been deployed from the surface 104, a cementitious slurry may be forward-circulated via the interior of the work string 150 directly behind the bottom plug launching member 310 (or, optionally, with a small volume of a spacer fluid between the cementitious slurry and the bottom plug launching member 310). Because the wipers 315 of the bottom plug launching member 310 sealably or substantially sealably engage the inner walls of the work string 150, the cementitious slurry is not intermingled or intermixed with (and, therefore, is not contaminated by) any fluid which may have been previously pumped via the work string 150.

In an embodiment, once the bottom plug launching member 310 reaches and engages the bottom plug mandrel portion 220 (thereby sealing the interior flow path), continued pumping will increase the force applied to the mandrel 210. Referring to FIG. 6, when the threshold at which the first controlled strength segment 230 will fail structurally is reached, the first controlled strength segment 230 will break, sever, separate, or otherwise fail structurally, causing the bottom plug mandrel portion 220 and the attached bottom plug body 270 (cumulatively referred to as the bottom plug 600) to separate from the SRP release apparatus 200 and move downhole within the casing 160. In an embodiment, application of such a force may cause the first controlled strength segment 230 to structurally fail completely and/or uniformly. Alternatively, the first controlled strength segment 230 may structurally fail in part. Where the first controlled strength segment 230 only partially structurally fails, fluid (e.g., the cementitious slurry) may flow into the interior bore of the casing 160 and exert a force against the bottom plug body 270 via the wipers 275, thereby bringing the first controlled strength segment 230 complete failure.

In an embodiment, port(s) 224 may prevent a pressure build-up (e.g., resulting from trapped pressure) between the top body 280 and bottom plug body 270 due to abrupt pressure changes that may occur while circulating and/or flowing a fluid prior to releasing the bottom plug. The port(s) 224 are bridged and sealed off on both sides of the port(s) when the bottom plug launching member 310 lands in the bottom plug mandrel portion 220 as illustrated in FIG. 6.

In an embodiment, the cementitious slurry continues to be pumped downhole until a desired volume of the cementitious slurry (e.g., a volume necessary to cement the casing 160 in place) has been pumped. The cementitious slurry will flow downward within the work string 150 through the SRP release apparatus and into the casing 160 behind the bottom plug 600. Because the wipers 275 of the bottom plug 600 sealably or substantially sealably engage the inner walls of the casing 160, the cementitious slurry is not intermingled or intermixed with (and, therefore, is not contaminated by) any fluid which may have been previously pumped via the casing 160.

Figure 7:
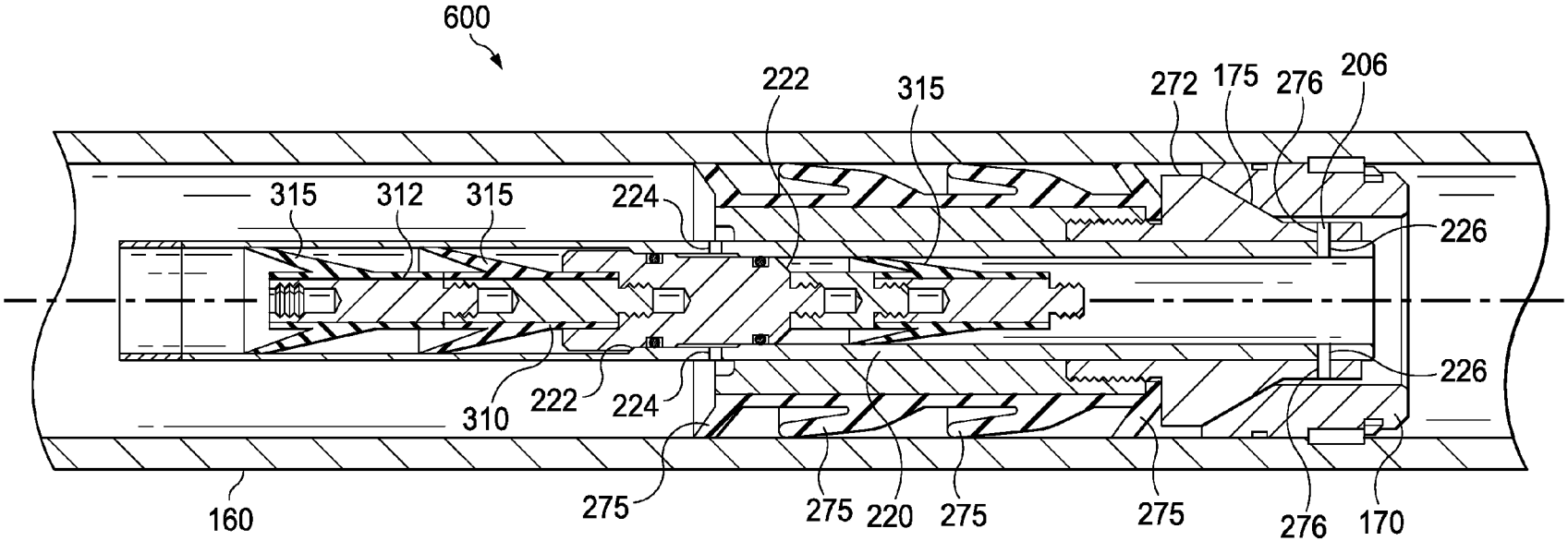
FIG. 7 is a cross-sectional illustration of an embodiment of a bottom plug separated from a SRP release apparatus and engaging a collar integrated within a casing.

Referring to FIG. 7, in an embodiment, as the cementitious slurry is pumped downhole, the bottom plug 600 continues to moves downward within the casing 160 until the bottom plug 600 reaches the collar 170. In the embodiment of FIG. 7, upon reaching the collar 170, the chamfer 272 of the bottom plug engages the complementary seat 175 within the collar 170, thereby prohibiting the bottom plug 600 from moving further downhole.

Figure 8:
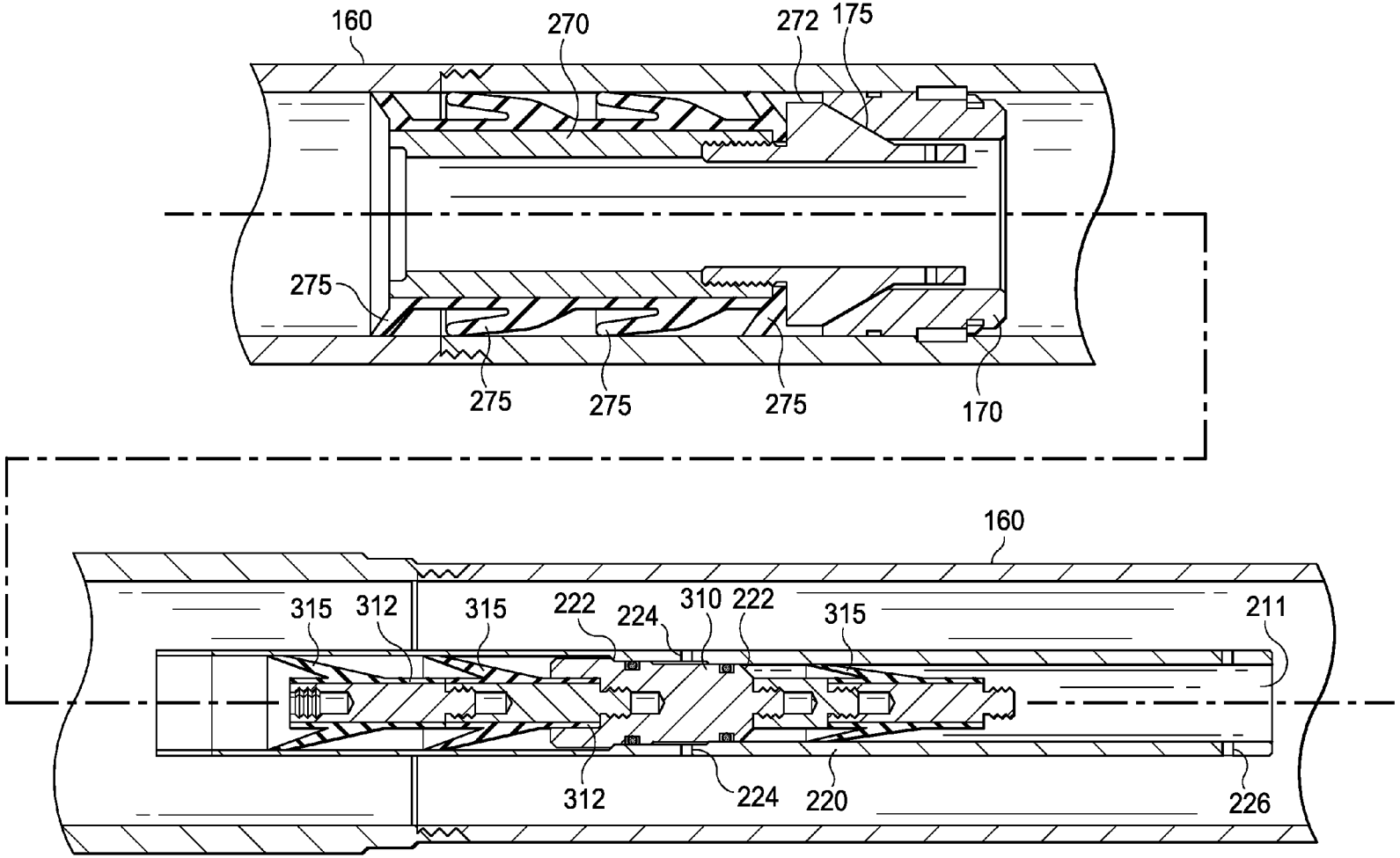
FIG. 8 is a cross-sectional illustration of an embodiment of a bottom plug mandrel portion separated from a bottom plug body portion within a casing.

Referring to FIG. 8, in an embodiment, once the bottom plug 600 engages the collar 170, continued pumping will increase the force applied to the bottom plug mandrel portion 220. When the threshold at which the frangible member (shear pin 206, illustrated in FIG. 7) will fail (which may be greater than the force necessary to cause structural failure of the first controlled strength segment 230) is reached, the shear pin 206 will break or otherwise fail structurally, causing the bottom plug mandrel portion 220 with the bottom plug launching member 310 engaged therein to move downward through the bottom plug body 270 while the bottom plug body is retained within the collar 170. In the embodiment of FIG. 8, the bottom plug mandrel portion 220 and bottom plug launching member 310 which is disposed within the bottom plug mandrel portion 220 separate from the bottom plug body 270 and collar 170 and move further downhole within the casing 160, followed by the cementitious slurry. The cementitious slurry continues to flow downward within the casing 160, through the open bore of the bottom plug body 270 until the cementitious slurry reaches the shoe 190 at the downhole terminal end of the casing 160 and then flows into the wellbore 114. In an embodiment, where the casing 160 comprises a bypass baffle above the one-way valve 180, the bypass baffle may catch the bottom plug mandrel portion 220 and/or the bottom plug launching member 310 while still allowing flow of the cementitious slurry into and through the shoe track without obstructing and/or damaging the one-way valve 180. The cementitious slurry may be allowed to flow into an annular space between the casing 160 and a wall of the wellbore 114, where the cementitious slurry may be allowed to set.

Figure 9:
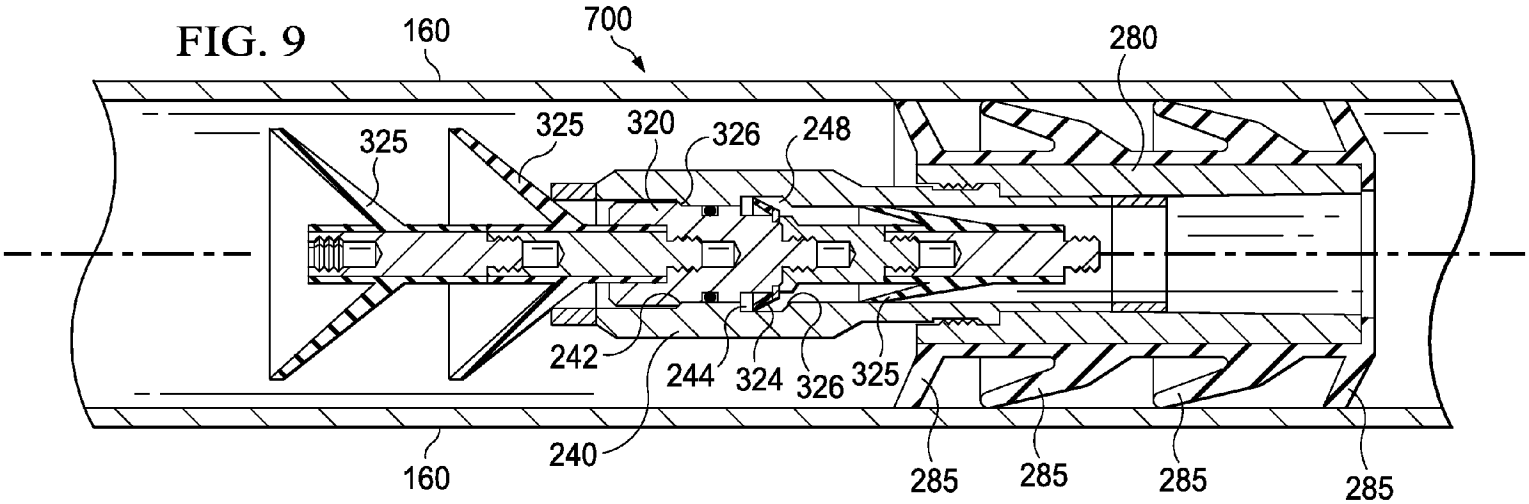
FIG. 9 is a cross-sectional illustration of an embodiment of a top plug separated from a SRP release apparatus and disposed within a casing.

In an embodiment, releasing the top plug may generally comprise causing structural failure of the second controlled strength segment 250. In an embodiment, causing structural failure of the second controlled strength segment 250 may comprise deploying the top plug launching member 320 (e.g., via the operation of the dart-launching apparatus 300 located at the surface 104) and pumping the top plug launching member 320 downhole via interior of the work string 150 to engage the seat within the top plug mandrel portion 240, as illustrated in FIG. 9. In the embodiment of FIG. 9, the chamfers 326 of the top plug launching member 320 engage the chamfers 242 within the top plug mandrel portion 240, thereby prohibiting the top plug launching member 320 from moving further downhole. Also in the embodiment of FIG. 9, when the top plug launching member 320 engages the top plug mandrel portion 240, the expandable ring 324 expands into recess 248 and interacts with shoulder 244, thereby prohibiting the top plug launching member 320 from moving upward relative to the top plug mandrel portion 240 after the top plug launching member has engaged a seat within the top plug mandrel portion 240, such as chamfers 242.

In an embodiment, after the top plug launching member 320 has been deployed from the surface 104, a servicing fluid may be forward-circulated via the work string 150 directly behind the top plug launching member 320, thereby displacing at least a portion of the cementitious slurry into the annular space between the casing 160 and a wall of the wellbore 114. Because the wipers 325 of the top plug launching member 320 sealably or substantially sealably engage the inner walls of the work string 150, the cementitious slurry is not intermingled or intermixed with (and, therefore, is not contaminated by) the servicing fluid which follows the top plug launching member within the work string 150.

In an embodiment, once the top plug launching member 320 engages the top plug mandrel portion 240 (thereby sealing the interior flow path), continued pumping will increase the force applied to the mandrel 210. Referring to FIG. 9, when the threshold at which the second controlled strength segment 250 will fail structurally is reached, the second controlled strength segment 250 will break, sever, separate, or otherwise fail structurally, causing the top plug mandrel portion 240 and the attached top plug body 280 (cumulatively referred to as the top plug 700) to separate from the SRP release apparatus 200 and move downhole within the casing 160. In an embodiment, application of such a force may cause the second controlled strength segment 250 to structurally fail completely and/or uniformly. Alternatively, the second controlled strength segment 250 may structurally fail in part. Where the second controlled strength segment 250 only partially structurally fails, fluid (e.g., the cementitious slurry) may flow into the interior bore of the casing 160 and exert a force against the top plug body 280 via the wipers 285, thereby bringing the second controlled strength segment 250 complete failure.

In an alternative embodiment where an SRP apparatus 400 is configured as disclosed with respect to FIG. 2B, when the force applied to the mandrel 410 via the top plug launching member 320 reaches a threshold (which may be greater than the force necessary to cause structural failure of the first controlled strength segment 430), a frangible member retaining the collet releasing sleeve 465 in the first, upper position will break, allowing the collet releasing sleeve 465 to slide forward to the second, lower position. When the collet releasing sleeve 465 slides to the second, lower position, the collet fingers 463 are allowed to flex inward into the radially-contracted, collapsed conformation and disengage the shoulder 448 of the collet retainer sleeve 447, and thereby releasing the top plug mandrel portion 440 and the attached top plug body, which cumulatively form the top plug. In other words, an embodiment where the SRP release apparatus is configured as SRP release apparatus 400, the collet 465 serves the function of the second controlled strength segment 250 in an embodiment where the SRP release apparatus is configured as SRP release apparatus 200.

Figure 10:
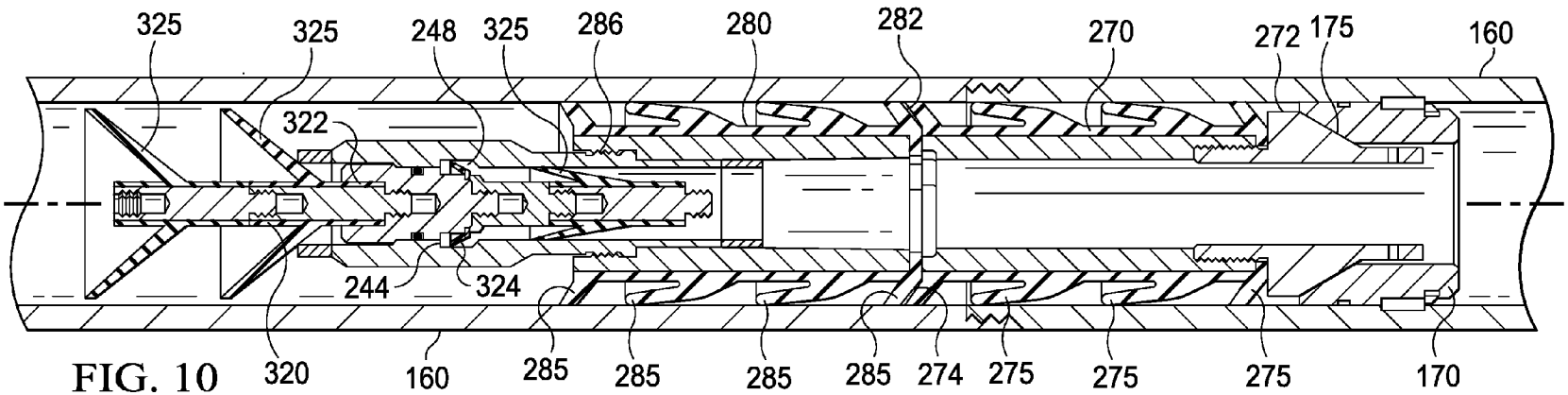
FIG. 10 is a cross-sectional illustration of an embodiment of a top plug separated from a SRP release apparatus and engaging a bottom plug body integrated within a casing.

Referring to FIG. 10, in an embodiment, as the servicing fluid is pumped downhole, the top plug 700 continues to moves downward within the casing 160 until the top plug 700 reaches the bottom plug body 270, which remains engaged with the landing collar 170 within the casing 160. In the embodiment of FIG. 10, upon reaching the bottom plug body 270, the chamfer 282 of the top plug 700 engages the complementary chamfer 274 of the bottom plug body 270, thereby prohibiting the top plug 700 from moving further downhole. In an embodiment, when the top plug 700 reaches the bottom plug body 270, the cementitious slurry may be substantially displaced from the casing 160 (with exception to the cementitious slurry remaining within the shoe track, below the landing collar 170) and positioned within the annular space between the casing 160 and a wall of the wellbore 114.

In an embodiment, it may be desirable to remove the top plug 700, the bottom plug body 270, and/or the collar 170 from the casing 160. In an embodiment where these components are formed from drillable materials, removal may comprise "drilling out" these components. In alternative embodiments, one or more of these components may removable by degradation, consumption, or other means known to one of skill in the art viewing this disclosure.

In an embodiment, the SRP release apparatus 200, 400 the SRP system 100, and/or the wellbore servicing methods employing the same as disclosed herein may be advantageously employed where prior art systems could not have been employed. For example, in an embodiment the SRP release apparatus 200, 400 and/or the SRP system 100 may be disposed within a relatively small-diameter casing string, whereas prior art subsurface release cementing plugs, which were released from collets, were too restrictive (as to fluid flow) as to be applied to the design on small diameter plug sets. The SRP release apparatus 200, 400 and/or the SRP system 100 as disclosed herein may be employed within a casing sized about 4.5 inches through about 7 inches. For example, the SRP release apparatus 200, 400 and/or SRP system 100 may be utilized in conjunction with a casing comprising an inner diameter of about 3.83 inches, alternatively, an inner diameter of less than about 6.54 inches.

It is noted that although some of the figures may exemplify a given operating environment, the principles of the devices, systems, and methods disclosed may be similarly applicable in other operational environments, such as offshore and/or subsea wellbore applications.

Additional Disclosure

The following are nonlimiting, specific embodiments in accordance with the present disclosure:

Embodiment A

A subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure;

a bottom plug body disposed about the bottom plug portion of the mandrel; and a top plug body disposed about the top plug portion of the mandrel.

Embodiment B

The subsurface release plug release apparatus of Embodiment A, wherein the mandrel is manufactured by a process comprising winding a plurality of fibers around a mandrel template.

Embodiment C

The subsurface release plug release apparatus of one of Embodiments A or B, wherein the bottom plug body is releasably secured to the bottom plug portion of the mandrel via a frangible member.

Embodiment D

The subsurface release plug release apparatus of one of Embodiments A through C, wherein the bottom plug body is configured to engage and be retained by a landing collar integrated within a casing string.

Embodiment E

The subsurface release plug release apparatus of one of Embodiments A through D, wherein the second release portion comprises a controlled strength segment configured to fail structurally and thereby release the top plug portion.

Embodiment F

The subsurface release plug release apparatus of one of Embodiments A through D, wherein the second release portion comprises a collet configured to contract and thereby release the top plug portion.

Embodiment G

The subsurface release plug release apparatus of one of Embodiments A through F, wherein the bottom plug portion is configured to sealably receive and retain a bottom plug launching member.

Embodiment H

The subsurface release plug release apparatus of one of Embodiments A through G, wherein the top plug portion is configured to sealably receive and retain a top plug launching member.

Embodiment I

The subsurface release plug release apparatus of one of Embodiments A through H, wherein the bottom plug mandrel portion further comprises a port, wherein the port is configured to equalize pressure between flowbore substantially defined by the mandrel and an exterior of the mandrel.

Embodiment J

A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure;

a bottom plug body disposed about the bottom plug portion of the mandrel; and a top plug body disposed about the top plug portion of the mandrel;

causing the first release portion to release the bottom plug portion by causing structural failure of the controlled strength segment;

pumping a cementitious slurry via the flowbore of the casing;

causing the second release portion to release the top plug portion;

displacing the cementitious slurry from the flowbore of the casing into an annular space between the casing and a wellbore wall; and allowing the cementitious slurry to set.

Embodiment K

The wellbore servicing method of Embodiment J, wherein the mandrel is manufactured by a process comprising winding a plurality of fibers around a mandrel template.

Embodiment L

The wellbore servicing method of one of Embodiments J or K, wherein the bottom plug body is releasably secured to the bottom plug portion of the mandrel via a frangible member.

Embodiment M

The wellbore servicing method of one of Embodiments J through L, further comprising pumping the bottom plug body and the bottom plug portion of the mandrel downward through the flowbore of the casing to engage a collar integrated within the casing, wherein engaging the collar retains the bottom plug body.

Embodiment N

The wellbore servicing method of one of Embodiments L or M, further comprising causing structural failure of the shear pin.

Embodiment O

The wellbore servicing method of Embodiment N, further comprising pumping the bottom plug portion of the mandrel downward through the collar while the bottom plug body is retained by the collar.

Embodiment P

The wellbore servicing method of Embodiment O, further comprising pumping the top plug body and the top plug portion of the mandrel downward through the flowbore of the casing to engage the bottom plug body.

Embodiment Q

The wellbore servicing method of one of Embodiments J through P, wherein the second release portion comprises a controlled strength segment configured to fail structurally and thereby release the top plug portion, and wherein causing the second release portion to release the top plug portion comprises causing structural failure of the controlled strength segment.

Embodiment R

The wellbore servicing method of one of Embodiments J through P, wherein the second release portion comprises a collet configured to contract radially and thereby release the top plug portion, and wherein causing the second release portion to release the top plug portion comprises causing the collet to expand radially.

Embodiment S

A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the top plug portion at a second fluid pressure, wherein the first fluid pressure is less than the second fluid pressure;

a bottom plug body disposed about the bottom plug portion of the mandrel; and a top plug body disposed about the top plug portion of the mandrel; pumping a first obturating member to pass through the top plug portion of the mandrel and engage a first seat within the bottom plug portion of the mandrel; applying a fluid pressure to cause the first release portion to release the bottom plug portion by causing structural failure of the first controlled strength segment;

pumping a second obturating member to engage a second seat within the top plug portion of the mandrel; and applying a fluid pressure to cause the second release portion to release the top plug portion.

Embodiment T

The method of Embodiment S, wherein the mandrel is manufactured by a process comprising winding a plurality of fibers around a mandrel template.

Embodiment U

The method of one of Embodiments S or T, wherein the bottom plug body is releasably secured to the bottom plug portion of the mandrel via a frangible member.

Embodiment V

The method of one of Embodiments S through U, further comprising pumping the bottom plug body and the bottom plug portion of the mandrel downward through the flowbore of the casing to engage a collar integrated within the casing, wherein engaging the collar retains the bottom plug body.

Embodiment W

The wellbore servicing method of one of Embodiments U or V, further comprising causing structural failure of the frangible member.

Embodiment X

The wellbore servicing method of Embodiment W, further comprising pumping the bottom plug body and the portion of the mandrel downward to engage a collar integrated within the casing, wherein the collar retains the bottom plug body.

Embodiment Y

The wellbore servicing method of Embodiment X, further comprising pumping the top plug body and the top plug portion of the mandrel downward through the flowbore of the casing to engage the bottom plug body.

Embodiment Z

The wellbore servicing method of one of Embodiments S through Y, wherein the second release portion comprises a controlled strength segment configured to fail structurally and thereby release the top plug portion, and wherein causing the second release portion to release the top plug portion comprises causing structural failure of the controlled strength segment.

Embodiment AA

The wellbore servicing method of one of Embodiments S through Y, wherein the second release portion comprises a collet configured to contract radially and thereby release the top plug portion, and wherein causing the second release portion to release the top plug portion comprises causing the collet to expand radially.

Embodiment AB

The wellbore servicing method of one of Embodiments S through AA, wherein the bottom plug portion of the mandrel comprises a port, and wherein the port provides fluid communication between an interior bore defined by the mandrel and an exterior portion of the mandrel between the bottom plug body and the top plug body prior to causing the bottom plug portion to be released.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

We claim:

1. A subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure, wherein the mandrel is manufactured by a process comprising winding a plurality of fibers around a mandrel template;

a bottom plug body disposed about the bottom plug portion of the mandrel; and a top plug body disposed about the top plug portion of the mandrel.

2. The subsurface release plug release apparatus of claim 1, wherein the bottom plug body is releasably secured to the bottom plug portion of the mandrel via a frangible member.

3. The subsurface release plug release apparatus of claim 1, wherein the bottom plug body is configured to engage and be retained by a landing collar integrated within a casing string.

4. The subsurface release plug release apparatus of claim 1, wherein the second release portion comprises a controlled strength segment configured to fail structurally and thereby release the top plug portion.

5. The subsurface release plug release apparatus of claim 1, wherein the second release portion comprises a collet configured to contract and thereby release the top plug portion.

6. The subsurface release plug release apparatus of claim 1, wherein the bottom plug portion is configured to sealably receive and retain a bottom plug launching member.

7. The subsurface release plug release apparatus of claim 1, wherein the top plug portion is configured to sealably receive and retain a top plug launching member.

8. The subsurface release plug release apparatus of claim 1, wherein the bottom plug mandrel portion further comprises a port, wherein the port is configured to equalize pressure between flowbore substantially defined by the mandrel and an exterior of the mandrel.

9. A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure, wherein the mandrel is manufactured by a process comprising winding a plurality of fibers around a mandrel template;

a bottom plug body disposed about the bottom plug portion of the mandrel; and a top plug body disposed about the top plug portion of the mandrel;

causing the first release portion to release the bottom plug portion by causing structural failure of the controlled strength segment;

pumping a cementitious slurry via the flowbore of the casing;

causing the second release portion to release the top plug portion;

displacing the cementitious slurry from the flowbore of the casing into an annular space between the casing and a wellbore wall; and allowing the cementitious slurry to set.

10. The wellbore servicing method of claim 9, wherein the bottom plug body is releasably secured to the bottom plug portion of the mandrel via a frangible member.

11. The wellbore servicing method of claim 10, further comprising pumping the bottom plug body and the bottom plug portion of the mandrel downward through the flowbore of the casing to engage a collar integrated within the casing, wherein engaging the collar retains the bottom plug body.

12. The wellbore servicing method of claim 11, further comprising causing structural failure of the shear pin.

13. The wellbore servicing method of claim 12, further comprising pumping the bottom plug portion of the mandrel downward through the collar while the bottom plug body is retained by the collar.

14. The wellbore servicing method of claim 13, further comprising pumping the top plug body and the top plug portion of the mandrel downward through the flowbore of the casing to engage the bottom plug body.

15. The wellbore servicing method of claim 9, wherein the second release portion comprises a controlled strength segment configured to fail structurally and thereby release the top plug portion, and wherein causing the second release portion to release the top plug portion comprises causing structural failure of the controlled strength segment.

16. The wellbore servicing method of claim 9, wherein the second release portion comprises a collet configured to contract radially and thereby release the top plug portion, and wherein causing the second release portion to release the top plug portion comprises causing the collet to expand radially.

17. A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the top plug portion at a second fluid pressure, wherein the first fluid pressure is less than the second fluid pressure;

a bottom plug body disposed about the bottom plug portion of the mandrel; and a top plug body disposed about the top plug portion of the mandrel, wherein the mandrel is manufactured by a process comprising winding a plurality of fibers around a mandrel template;

pumping a first obturating member to pass through the top plug portion of the mandrel and engage a first seat within the bottom plug portion of the mandrel;

applying a fluid pressure to cause the first release portion to release the bottom plug portion by causing structural failure of the first controlled strength segment;

pumping a second obturating member to engage a second seat within the top plug portion of the mandrel; and applying a fluid pressure to cause the second release portion to release the top plug portion.

18. The method of claim 17, wherein the bottom plug body is releasably secured to the bottom plug portion of the mandrel via a frangible member.

19. The method of claim 18, further comprising pumping the bottom plug body and the bottom plug portion of the mandrel downward through the flowbore of the casing to engage a collar integrated within the casing, wherein engaging the collar retains the bottom plug body.

20. The wellbore servicing method of claim 19, further comprising causing structural failure of the frangible member.

21. The wellbore servicing method of claim 20, further comprising pumping the bottom plug body and the portion of the mandrel downward to engage a collar integrated within the casing, wherein the collar retains the bottom plug body.

22. The wellbore servicing method of claim 21, further comprising pumping the top plug body and the top plug portion of the mandrel downward through the flowbore of the casing to engage the bottom plug body.

23. The wellbore servicing method of claim 17, wherein the second release portion comprises a controlled strength segment configured to fail structurally and thereby release the top plug portion, and wherein causing the second release portion to release the top plug portion comprises causing structural failure of the controlled strength segment.

24. The wellbore servicing method of claim 17, wherein the second release portion comprises a collet configured to contract radially and thereby release the top plug portion, and wherein causing the second release portion to release the top plug portion comprises causing the collet to expand radially.

25. The wellbore servicing method of claim 17, wherein the bottom plug portion of the mandrel comprises a port, and wherein the port provides fluid communication between an interior bore defined by the mandrel and an exterior portion of the mandrel between the bottom plug body and the top plug body prior to causing the bottom plug portion to be released.

26. A subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure;

a bottom plug body disposed about the bottom plug portion of the mandrel, wherein the bottom plug body is releasably secured to the bottom plug portion of the mandrel via a frangible member; and a top plug body disposed about the top plug portion of the mandrel.

27. A subsurface release plug release apparatus comprising:

a mandrel comprising:

a bottom plug portion, wherein the bottom plug mandrel portion further comprises a port, wherein the port is configured to equalize pressure between flowbore substantially defined by the mandrel and an exterior of the mandrel;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure;

a bottom plug body disposed about the bottom plug portion of the mandrel; and a top plug body disposed about the top plug portion of the mandrel.

28. A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the bottom plug portion at a second fluid pressure, wherein the first fluid pressure is less than the second fluid pressure;

a bottom plug body disposed about the bottom plug portion of the mandrel, wherein the bottom plug body is releasably secured to the bottom plug portion of the mandrel via a frangible member; and a top plug body disposed about the top plug portion of the mandrel;

causing the first release portion to release the bottom plug portion by causing structural failure of the controlled strength segment;

pumping a cementitious slurry via the flowbore of the casing;

causing the second release portion to release the top plug portion;

displacing the cementitious slurry from the flowbore of the casing into an annular space between the casing and a wellbore wall; and allowing the cementitious slurry to set.

29. A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the top plug portion at a second fluid pressure, wherein the first fluid pressure is less than the second fluid pressure;

a bottom plug body disposed about the bottom plug portion of the mandrel, wherein the bottom plug body is releasably secured to the bottom plug portion of the mandrel via a frangible member; and a top plug body disposed about the top plug portion of the mandrel;

pumping a first obturating member to pass through the top plug portion of the mandrel and engage a first seat within the bottom plug portion of the mandrel;

applying a fluid pressure to cause the first release portion to release the bottom plug portion by causing structural failure of the first controlled strength segment;

pumping a second obturating member to engage a second seat within the top plug portion of the mandrel; and applying a fluid pressure to cause the second release portion to release the top plug portion.

30. A wellbore servicing method comprising:

positioning a casing defining a flowbore within a wellbore with a subsurface release plug release apparatus disposed within a portion of the casing, the subsurface release plug release apparatus comprising:

a mandrel comprising:

a bottom plug portion, wherein the bottom plug portion of the mandrel comprises a port, and wherein the port provides fluid communication between an interior bore defined by the mandrel and an exterior portion of the mandrel between the bottom plug body and the top plug body prior to causing the bottom plug portion to be released;

a top plug portion;

a work string attachment portion;

a first release portion between the bottom plug portion and the top plug portion, wherein the first release portion comprises a controlled strength segment configured to fail structurally and thereby release the bottom plug portion at a first fluid pressure; and a second release portion between the top plug portion and the work string attachment portion, wherein the second release portion is configured to release the top plug portion at a second fluid pressure, wherein the first fluid pressure is less than the second fluid pressure;

a bottom plug body disposed about the bottom plug portion of the mandrel; and a top plug body disposed about the top plug portion of the mandrel;

pumping a first obturating member to pass through the top plug portion of the mandrel and engage a first seat within the bottom plug portion of the mandrel;

applying a fluid pressure to cause the first release portion to release the bottom plug portion by causing structural failure of the first controlled strength segment;

pumping a second obturating member to engage a second seat within the top plug portion of the mandrel; and applying a fluid pressure to cause the second release portion to release the top plug portion.

* * * * *